US006050059A

United States Patent [19]

Rea

[11] Patent Number: 6,050,059

[45] Date of Patent: Apr. 18, 2000

[54] PACKAGING APPARATUS

[75] Inventor: Dario Rea, Calcara di Crespellano, Italy

[73] Assignee: I.M.A. Industria Macchine Automatiche S.p.A., Bologna, Italy

[21] Appl. No.: 09/063,011

[22] Filed: Apr. 21, 1998

[30] Foreign Application Priority Data

Apr. 22, 1997 [IT] Italy ..... B097A0241

[51] Int. Cl.[7] ..... B65B 29/04

[52] U.S. Cl. ..... 53/413; 53/134.2; 53/139.4; 53/205

[58] Field of Search ..... 53/413, 134.2, 53/139.4, 205

[56] References Cited

U.S. PATENT DOCUMENTS

| | | | |
|---|---|---|---|
| 1,497,276 | 6/1924 | Hirschhorn | 53/413 X |
| 1,726,060 | 8/1929 | Doble | 53/413 |
| 1,739,633 | 12/1929 | English | 53/134.2 |
| 1,857,625 | 5/1932 | Doble | 53/134.2 |
| 1,857,662 | 5/1932 | Rohrig | 53/134.2 |
| 1,869,116 | 7/1932 | Rambold | 53/134.2 |
| 1,911,805 | 5/1933 | Cleaves | 53/134.2 |
| 1,956,901 | 5/1934 | Irmscher | 53/134.2 |
| 1,983,727 | 12/1934 | Allatt | 53/134.2 |
| 2,006,356 | 7/1935 | Irmscher | 53/134.2 |
| 2,148,587 | 2/1939 | Slocum | 53/413 |
| 2,328,639 | 9/1943 | Gaertner | 53/134.2 |
| 2,430,280 | 11/1947 | Eaton et al. | 53/134.2 X |

FOREIGN PATENT DOCUMENTS 450703 7/1936 United Kingdom .

*Primary Examiner*—Daniel B. Moon
*Attorney, Agent, or Firm*—Pillsbury Madison & Sutro LLP

[57] ABSTRACT

The packaging apparatus for bags containing products for infusion envisages a plurality of stations located one after another along a feed line and used first to continuously cut successive individual pieces of fabric from a continuous strip of fabric, then to transform the piece of fabric from its flat configuration to a bag configuration, tubular in shape and with an open top which forms the mouth and into which a dose of product is inserted; the tubular bag is then moved to stations which cut the excess part of the mouth to size and close the mouth by tying it with a continuous thread, so as to form a closed bag, containing a single dose of product and having a projecting upper portion of thread; finally, a label is attached to the thread on each bag and the label is inserted in the bag tying zone.

38 Claims, 15 Drawing Sheets

(a)
(b)
(c)
(d)
(e)
(f)
(g)
(h)
(i)
10
8
79
25
2
28
4
43
F43
1
A
58
51
5
6
6a
22
23
95
68
97
96

Z
38
98c
98b
67
41
R
98s
40
1
PZ1
40c
40b
98
V
66
Z2

98b
98
98c
V
98s
98a
98g
98r
98

PACKAGING APPARATUS

BACKGROUND OF THE INVENTION

The present invention relates to a packaging apparatus, in particular for making bags for products for infusion, such as tea, coffee, chamomile, etc.

The many types of bags used for the infusion of products such as tea, coffee or chamomile (the best known having a single or double lobe shape), include some with a particular shape which do not comply with the typical shapes currently used, but use packaging materials and configurations which cannot be adapted to the normal automatic apparatus which make the above-mentioned conventional single or double lobe filter bags.

The bags made by the apparatus which is the object of the present invention are of the "bundle" type, for example, as illustrated in patent GB-450.703 and are made from a piece of fabric preferably with a wide weft (e.g.: gauze) upon which a dose of product for infusion is deposited and which is closed in the piece of fabric by raising the sides of the fabric towards a single point, which forms the mouth of the bag, thus creating a bundle containing the dose of product.

The mouth of the bag is closed by bringing together the free sides and firmly blocking them together in this position, using a metal ring or a knotted thread wound around the zone below, close to the point at which the free sides are brought together.

If the sides are held together by a metal ring, as the ring and bag are put together, the end of a thread is attached to the ring, the opposite end of the thread being free and having a pick-up label zone, designed to allow the bag to be handled when immersed in a liquid to make the infusion.

If the bag is tied with a thread, it is a portion of the same thread which extends for attachment to the free end of this portion of the pick-up label zone thread.

The above-mentioned bag with thread closure is currently made manually by operators who pick up the piece of fabric upon which the product is deposited, close it by bringing together the edges, then tie the thread in place and attach the pick-up label zone.

SUMMARY OF THE INVENTION

For this purpose the Applicant has invented an apparatus for the production of bags for products for infusion of the above-mentioned type, that is to say, bundle shaped and with a thread closure, which is fully automated; bags are produced in extremely rapid cycles, with a high level of safety at all stages, and an overall reduction in costs.

BRIEF DESCRIPTION OF THE DRAWINGS

The technical features of the invention, in accordance with the afore-mentioned aims, are clearly described in the claims herein and the advantages of the invention are more clearly described below with reference to the accompanying drawings, which show a preferred embodiment of the invention, and in which:

DESCRIPTION OF THE PREFERRED EMBODIMENTS

Figure 1:
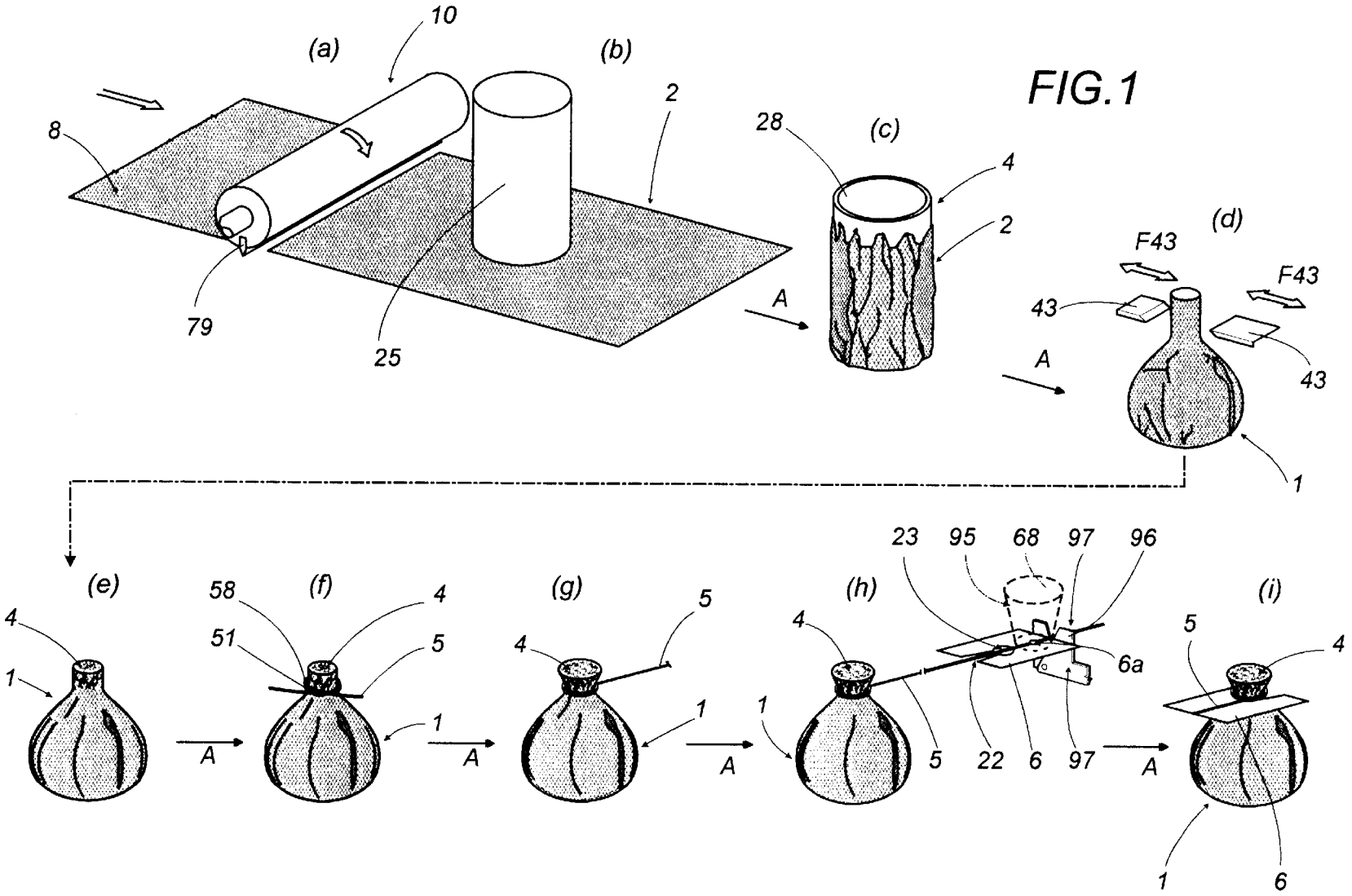
FIG. 1 illustrates a sequence of stages, labeled below with letters "a" to "i", for the manufacture of a bag designed to contain products for infusion, made using the packaging apparatus disclosed, all stages being illustrated in schematic perspective views.

In accordance with the accompanying drawings, and in particular with reference to FIG. 1, the packaging apparatus disclosed is designed to produce bags 1 for products for infusion, such as tea, coffee, chamomile, etc.

In particular, these bags 1 each consist of a piece 2 of usually loosely woven fabric (for example, gauze), although other types of weaves are not excluded.

A dose 3 of the above-mentioned product is deposited on the fabric 2; the dose 3 is closed inside the fabric by folding the sides of the fabric 2 over until the free edges are brought together at a given point to form the mouth 4 of the bag, at which a tying thread 5, wound around the bag to close it is envisaged. A label 6 is attached to the opposite, free end of the thread 5, the label designed to support and allow handling of the bag 1 when making the infusion.

The apparatus disclosed, in particular see FIGS. 2, 3 and 4, mainly consists of a plurality of stations, divided into eight to facilitate the description, some of which (more clearly illustrated below), incorporate two or more elements for the production of the above-mentioned bag 1.

In the following text, most of the operating elements described have a "stepping" movement, with the pauses necessary to carry out the operations required for bag production.

These eight stations are located one after another along a feed line A and are described according to the operating "chronology" for bag 1 production.

The first station, labeled 7, allows the feed of a continuous strip 8 of the above-mentioned woven fabric towards a second station 9. The continuous strip 8 (see FIG. 2) is fed from a reel 77 by means of a motor driven pre-unwinding unit 78*a,* and a subsequent stepping unwinding unit 78, both of known types. The reel 77 is located upstream of the second station 9 relative to the direction of feed A.

The stepping unit 78 allows the continuous strip 8 of fabric to arrive at the second station 9; this is equipped with a transverse cutting unit 10 for the strip 8, designed to cut a series of flat (see FIG. 1*b*) pieces 2 of fabric. The cutting unit 10 is not fully illustrated, being of the known type and consisting of, for example, a transverse blade 79 radially supported by a roller 80.

The flat piece of fabric 2 is transferred to a third station 11 (see also FIGS. 5 and 6) equipped with generic means 12 which transform the flat piece of fabric 2 to the bag configuration, that is to say, tubular in shape, with an open top which forms the above-mentioned mouth 4. In addition, the third station 11 comprises means 13 which feed a dose 3 of product into the bag formed in this way.

Figure 5:
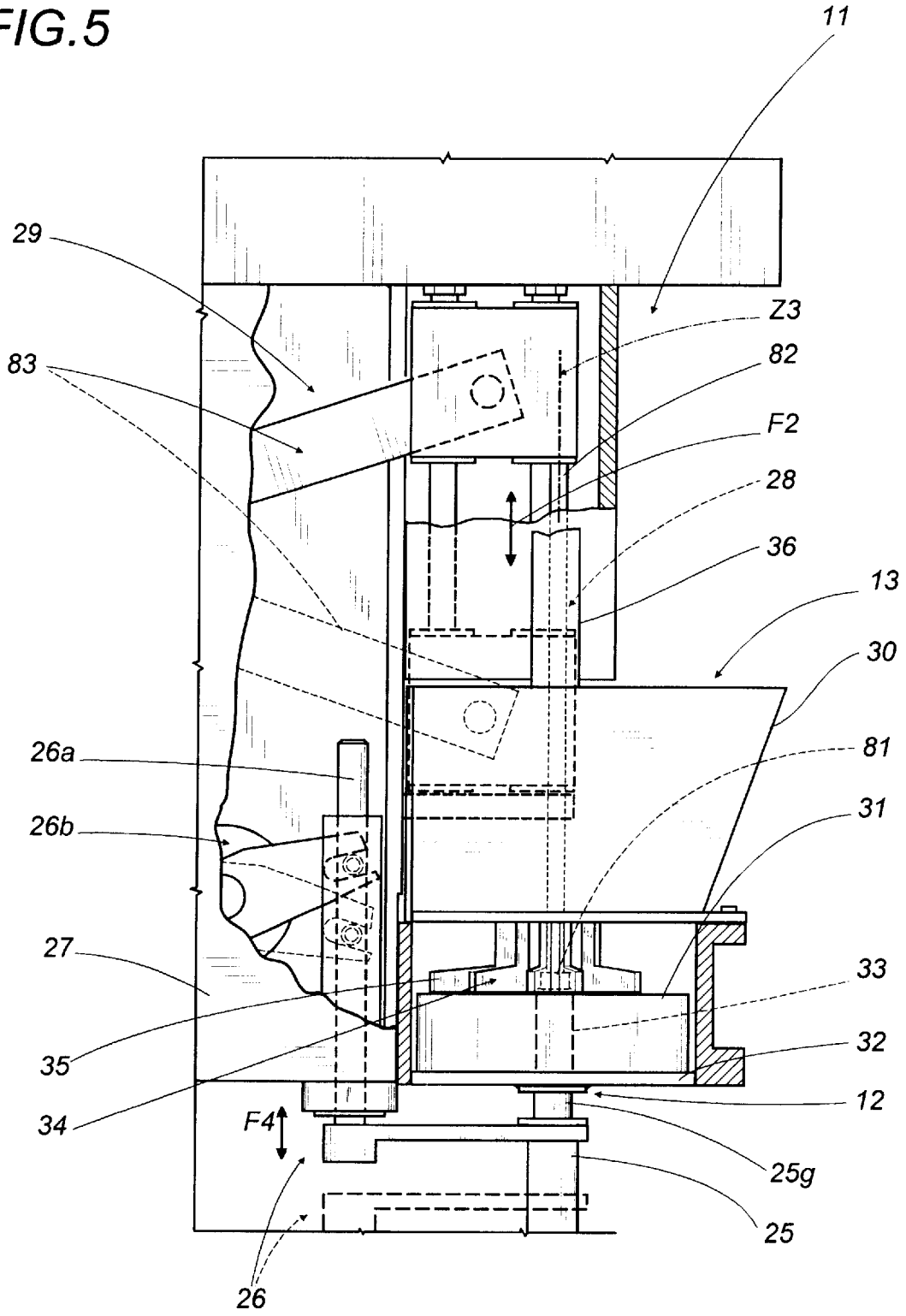
FIG. 5 is a schematic side view of a station included in the apparatus shown in FIGS. 2, 3 and 4, in particular a station which forms the bag and fills it with the product, with some parts cut away to better illustrate others.
Figure 6:
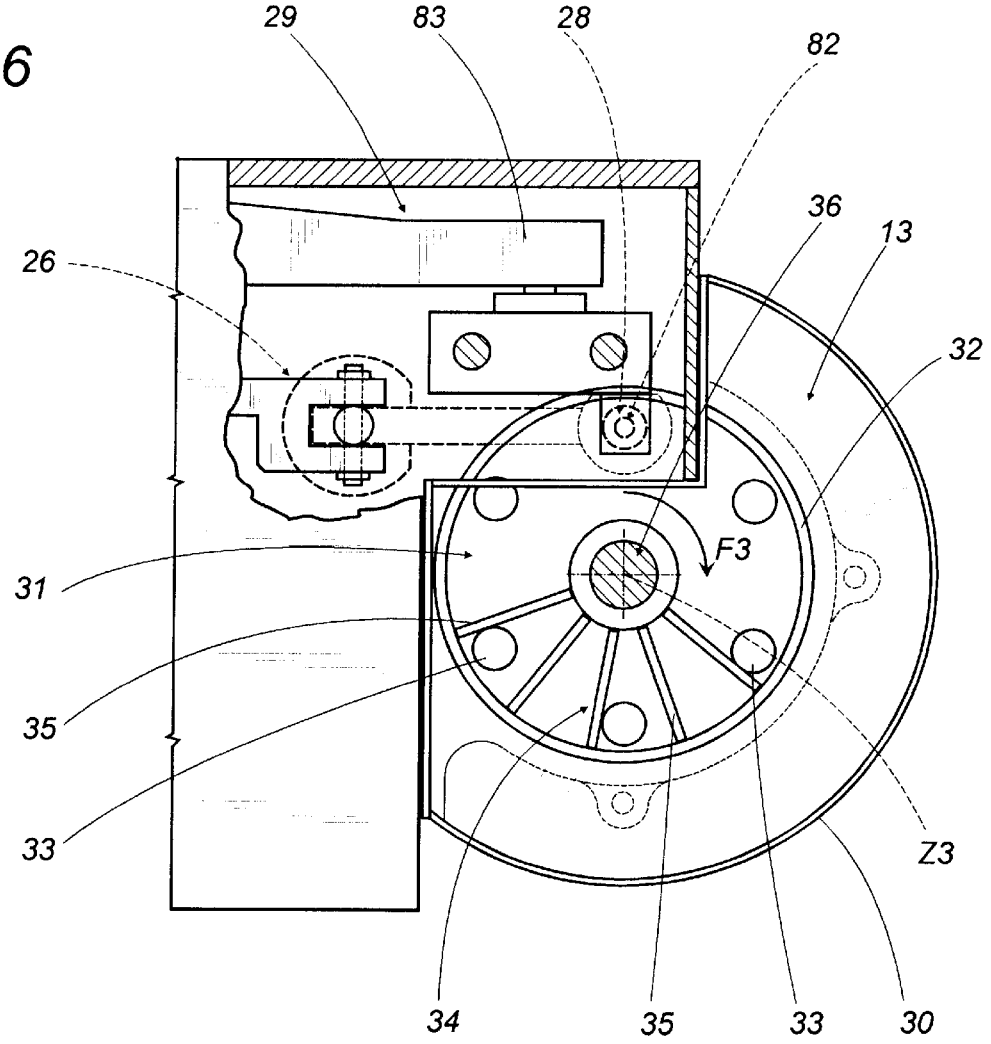
FIG. 6 is a partial top view of the forming and dosing station shown in FIG. 5, with some parts cut away to better illustrate others.

More precisely, again see FIGS. 5 and 6, the above-mentioned means 12 for formation of the fabric bag consist of an open tubular element 25, positioned vertically relative to the feed line A; this tubular element 25 is supported and moved by the end of a horizontal arm 26 attached to a support structure 27 on the apparatus. This arm 26 moves (see arrow F4 in FIG. 5) between two end positions: towards the support structure 27 (shown as a continuous line in FIG. 5) and away from the structure (shown as a dashed line in FIG. 5), the reason for this movement being described below.

Figure 5A:
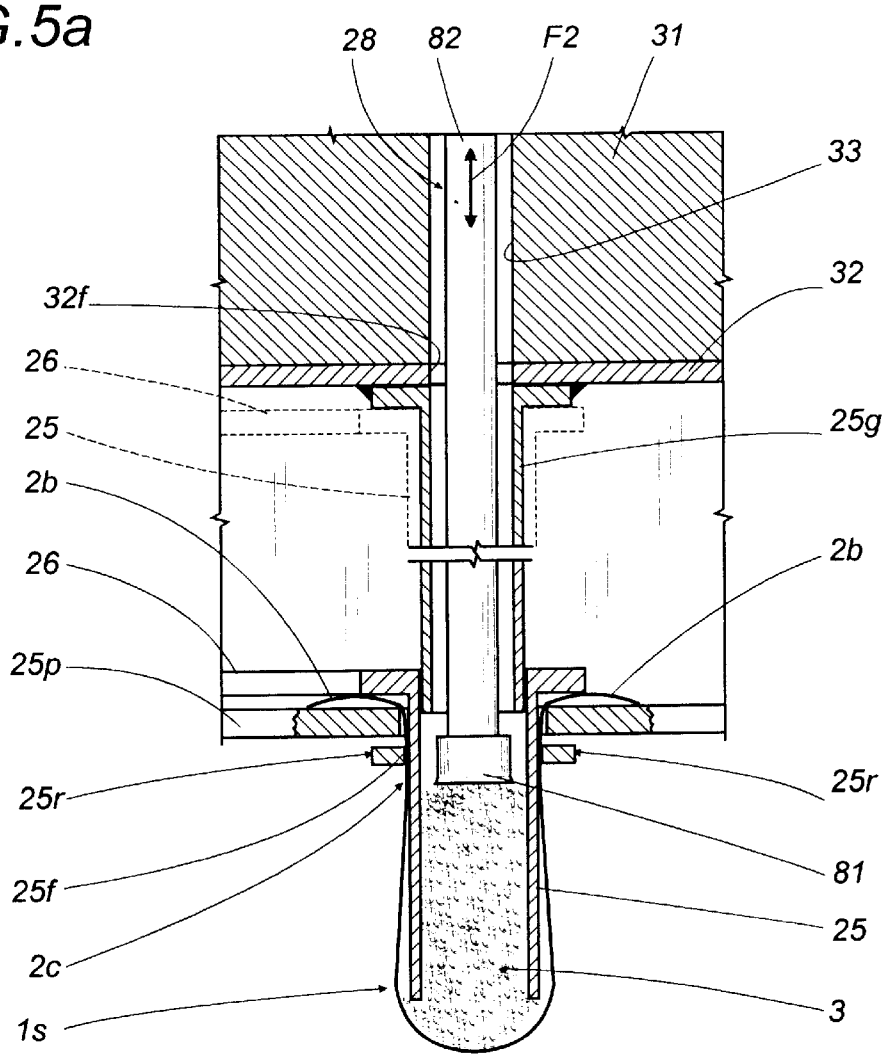
FIG. 5*a* is a schematic side view of a scaled-up detail of the station shown in FIG. 5, with some parts shown in cross section and others cut away.

With reference to the schematic FIG. 5*a,* the tubular element 25 moves vertically relative to a fixed internal element 25*g,* between two end positions illustrated in FIG. 5*a,* the upper shown as a dashed line and the lower as a continuous line. During its operative downstroke, the tubular element intercepts the initially flat piece of fabric 2, deforming it so that it takes on a bag shape, as shown, with the edges 2*b* resting on a contrast and sliding surface 25*p*. A hole 25*f* for "drawing" the piece of fabric 2 is also present in this surface 25*p*. Following this stage, holding means 25*r* act upon the portion of the bag near to the lower part of the surface 25*p,* labeled 2*c,* holding the bag in the configuration shown in FIG. 5*a* during the subsequent operation for insertion of the dose 3; these means 25*r* preferably consist of grippers which make contact with the exterior of the tubular element 25 (also shown in schematic FIG. 5*b*).

The dose 3 is inserted by a presser or ejector 28 coaxial to the tubular element 25. This presser 28, including an end pad 81 which is integral with a vertical rod 82, is moved by relative means 29, towards (and respectively away from) the bag 2*s* (see arrow F2 in FIGS. 5 and 5*a*), inserting the dose 3 in the bag.

The above-mentioned drive means 29 are shown in FIG. 5 as a mechanism consisting of a lever 83 attached to the rod 82 and in turn connected to relative drive means (not illustrated here, being of the known type) which allow the presser 28 to be raised and lowered.

The above-mentioned dose 3 feed means 13 consist of a product feed hopper 30, positioned above a product holder and dosing drum 31.

This drum 31 (revolver shaped) can rotate about its vertical axis Z3 (see arrow F3 in FIG. 6), and has a plurality of through-holes 33 (each forming a product dosing compartment), evenly distributed over the circumference of the drum 31, whose lower section is closed by a base 32 which has a single hole 32*f,* for the passage and discharge of the dose at the presser 28 vertical position.

The drum 31 is also operated upon by means 34 designed to allow even product distribution as the product drops into the holes 33.

These means 34 preferably consist of a plurality of mixing blades 35 which rotate above the drum 31 about the vertical axis Z3, that is to say, integral with a shaft that is positioned coaxial to the drum support shaft 36.

Returning to the support arm 26 for the tubular element 25, as already indicated, the arm moves between the above-mentioned end positions, the vertical movement being driven by a mechanism consisting of a vertical pin 26*a* which supports the arm 26, the pin 26*a* being connected to and moved by a lever mechanism 26*b* connected to drive means which are not illustrated.

Figure 5B:
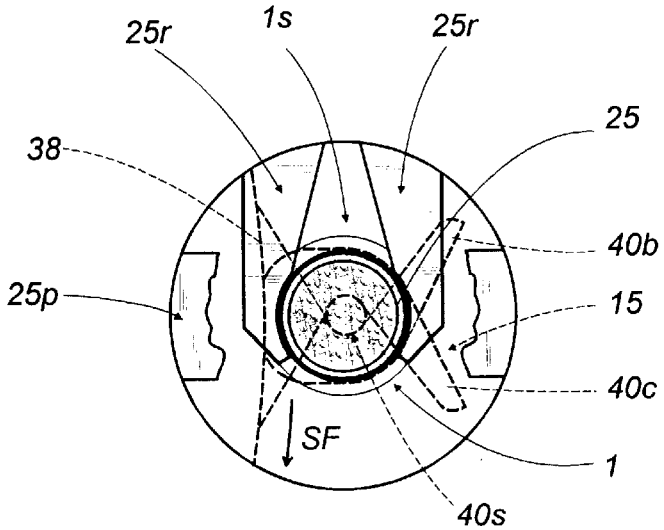
FIG. 5*b* is a schematic top plan view of a scaled-up detail relative to FIG. 5*a,* with some parts cut away to better illustrate others.

When the tubular element 25 is moved away from the bag 2*s,* that is to say, when it returns to the raised position (shown as a dashed line in FIG. 5*a*), the bag remains substantially suspended in the gripper means 25*r,* with the dose 3 inside it, in a position which allows the bag 2*s* to be picked up by first bag pick-up means 15; more precisely, the gripper means 25*r* carry out pre-closing of the mouth 4 of the bag 1 in such a way that they do not prevent subsequent bag pick-up, during which the bag is drawn by the above-mentioned first means 15, as shown in FIG. 5*b,* in which the bag is drawn in the direction labeled SF. The bag, complete with dose 3, is hereinafter labeled 1.

Figure 3:
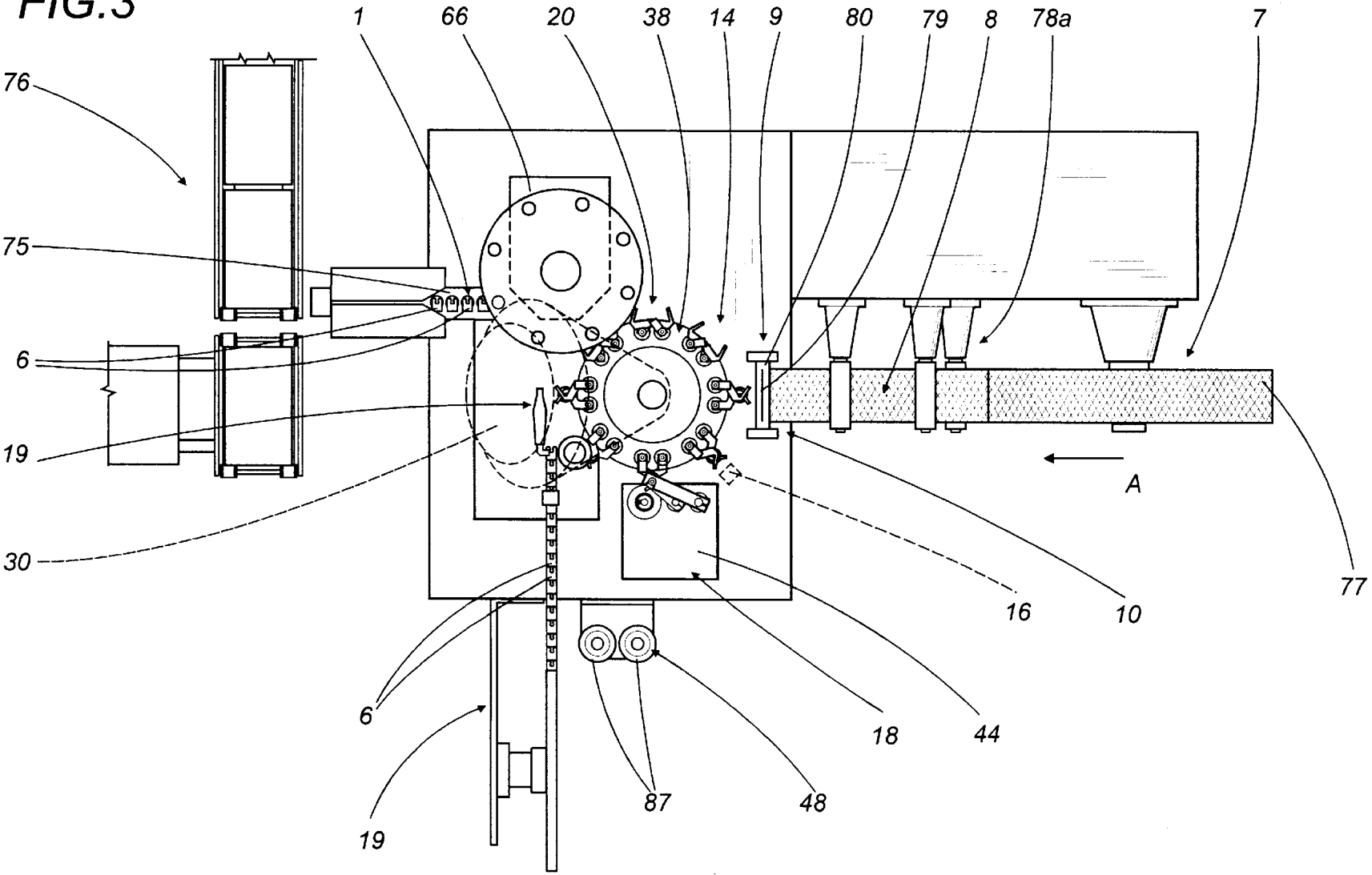
Figure 7:
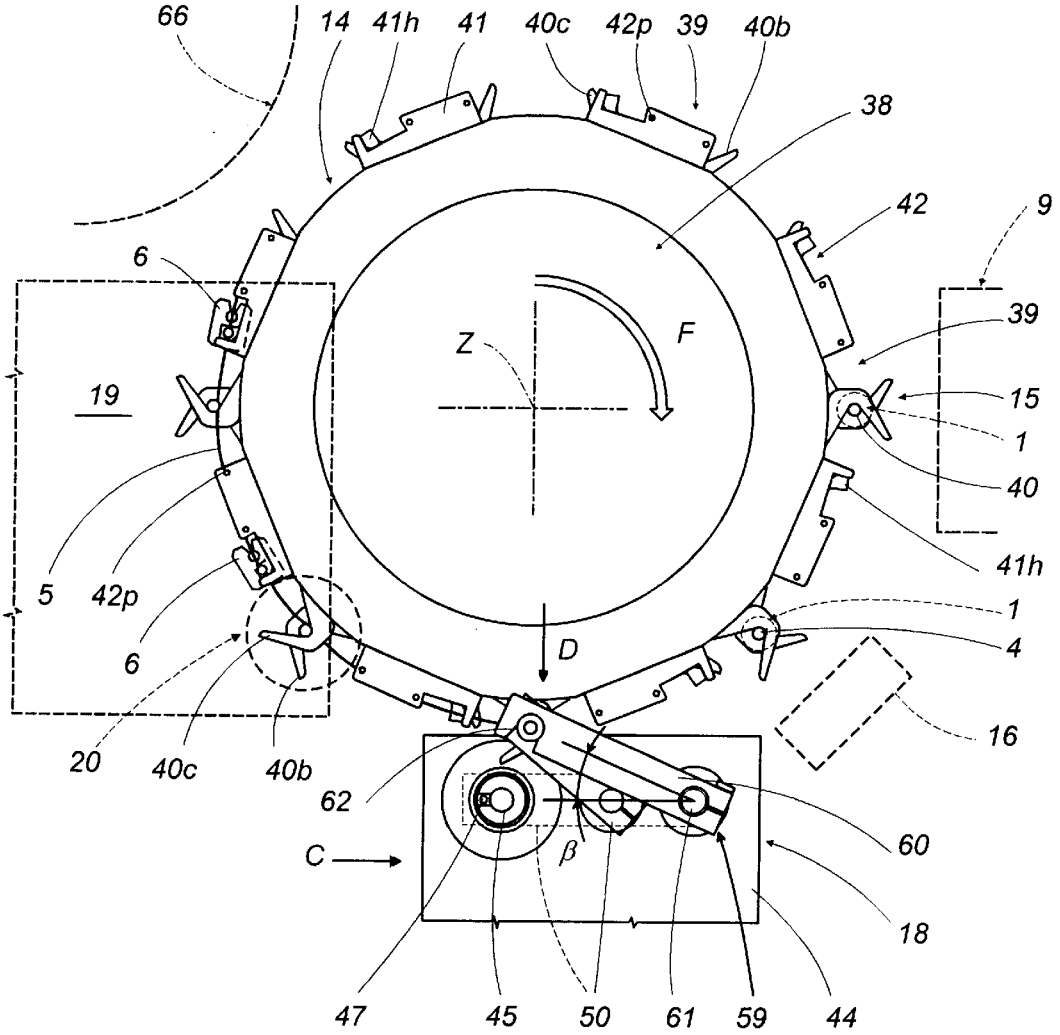
FIG. 7 is a schematic top plan view of another two stations on the above-mentioned apparatus shown in FIGS. 2, 3 and 4, in particular a bag pick-up and transfer station and a station for application of a bag tying thread, with some parts cut away to better illustrate others.
Figure 12:
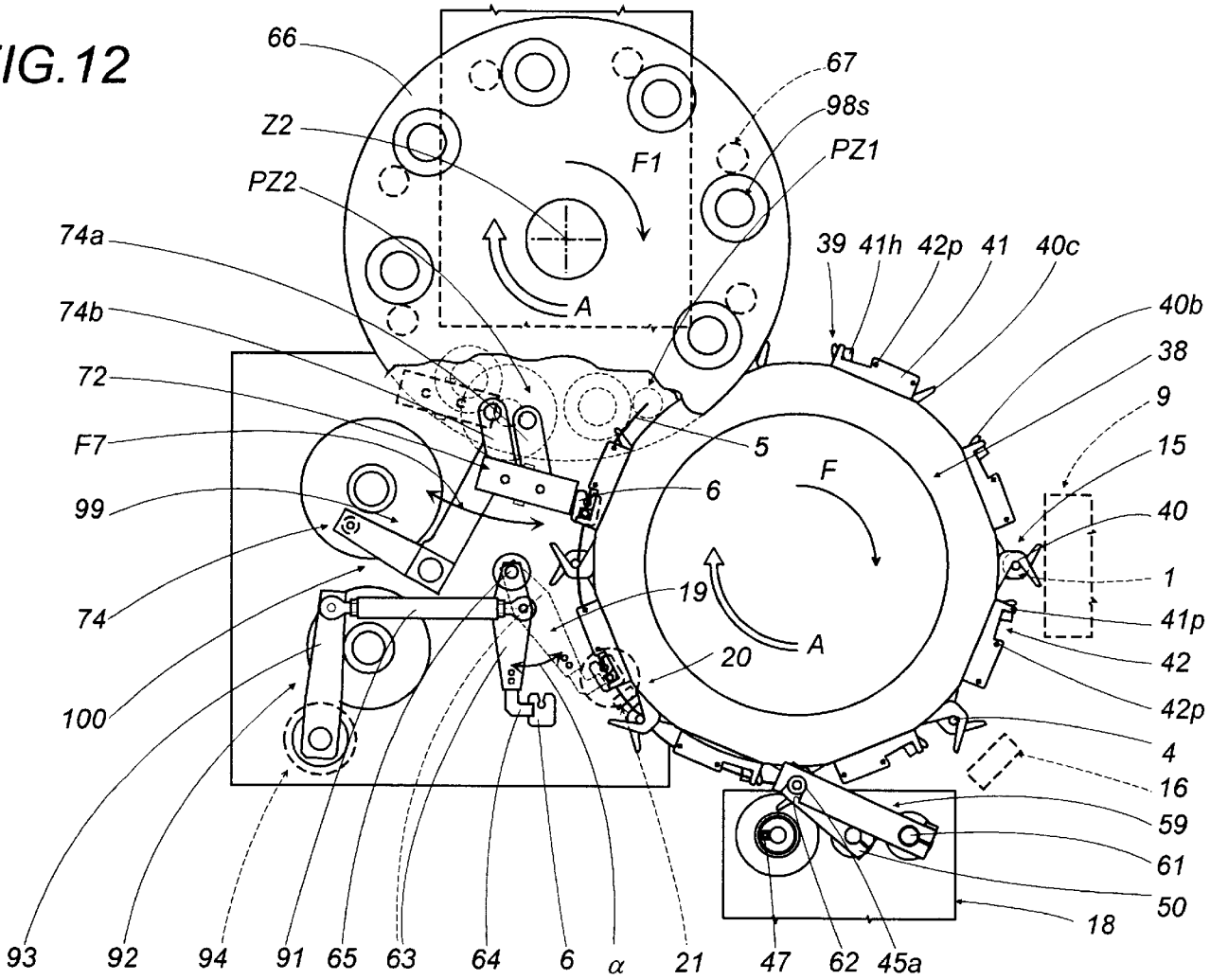
FIG. 12 shows other stations on the apparatus shown in FIGS. 2, 3 and 4, in particular a station for application of a label to a thread attached to the bag and a station which attaches the label to the bag.

As shown in FIGS. 3, 7 and 12, the first pick-up means 15 are part of a fourth, transfer station 14, designed to transfer each bag 1 to the subsequent stations located near and along the path of the fourth station: in order to carry out the relative operations required to close the bag which has just been configured.

More precisely, this fourth station 14 consists of a first carousel 38 with vertical axis of rotation Z and a plurality of operating zones 39 evenly distributed over the external circumference of the first carousel 38.

Each operating zone 39 may comprise grippers 40 which grip the portion of the bag 1 below the mouth 4, therefore forming the above-mentioned pick-up means 15, and a surface 41, on a plane above the grippers 40, the surfaces 41 being alternated with the grippers. Each surface 41 has a seat 42 for housing a relative label (described more clearly below), vertical pins 42*p* being envisaged at the side of the seat and, as described below, holding a continuous thread 5, used to join the bag 1 and label 6, defining half an arc which copies the external circumference of the first carousel 38 as it moves forward and towards the subsequent stations.

As shown in FIGS. 7, 12, 14, 15 and 18, each of the grippers 40 consists of a body 40*a* with a pair of jaws 40*b*, 40*c* which can rotate about the vertical axis 40Z of the body 40*a*. The jaws 40*b*, 40*c* are shaped in such a way that, when turned in the closing configuration (this position clearly shown in FIGS. 7, 12 and 18), they form a complementary seat 40*s* to support and house the part of the mouth 4 not affected by the closing operations described below.

Again observing FIG. 3, the numeral 16 is used to label a fifth station equipped with means 17 for cutting a predetermined part of the upper end of the tubular bag 1, that is to say, part of the mouth 4 located above and not touched by the pick-up grippers 40.

Figure 14:
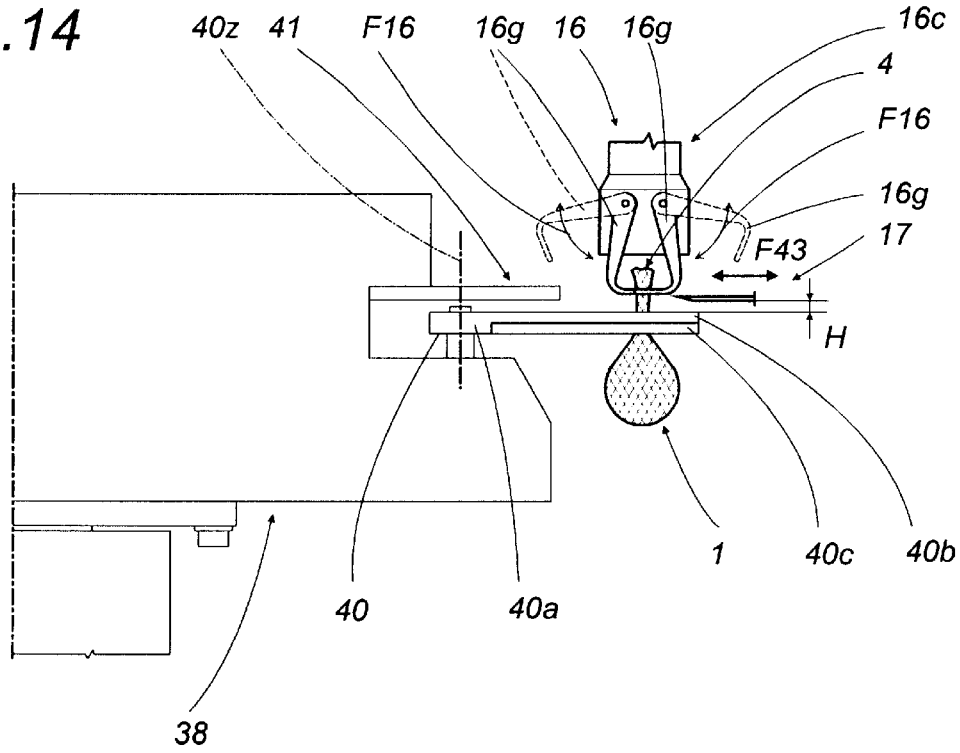
FIG. 14 is a schematic front view of a station on the apparatus disclosed, in particular a station for cutting the part of the bag that is not tied, with some parts cut away to better illustrate others.

As is also visible in FIG. 1*d* and 14, the fifth station 16 may consist of one or two blades 43, supported by a relative structure located near the fourth station 14. This blade 43 moves, see arrow F43, between a forward, operating position, in which the blade 43 intercepts the portion of the bag 1 which forms the mouth 4 at a given predetermined height H relative to the grippers 40, and a retracted, home position, shown with a continuous line in FIG. 14.

As schematically illustrated in FIG. 14, to obtain a correct cut which is suited to the subsequent closing operations (described in more detail below), the free end of the mouth 4 is closed, during the cutting stage, to form as cylindrical a portion as possible, by a pair of jaws 16*g* which move above the grippers 40.

These jaws 16*g* move between two end positions (see arrows F16), respectively the idle position (shown as a dashed line in FIG. 14), in which the jaws are moved away from one another and from the mouth 4, and an operating position, in which the jaws 16*g* are brought together and clamp the part above the mouth 4 (shown as a continuous line in FIG. 14). Therefore, in the operating position, the jaws 16*g* clamp the end of the mouth 4, holding it vertical to contrast the cutting stage. An ejection unit for the waste cut is preferably located above the jaws 16*g;* this unit may consist of a vacuum duct 16*c*.

In FIGS. 3, 4, 7, 8, 9 and 18, the numeral 18 is used to label a sixth station, located downstream of the previous fifth, cutting station 16 on the feed line A. This sixth station 18 allows the winding and relative closing by tying off of the remaining end of the mouth 4 of the tubular fabric bag with a continuous thread 5, so as to form a closed bag 1, containing a single dose and with a projecting portion of thread 5.

More specifically, the sixth station 18 consists of a unit 44 located near the first carousel 38, the unit 44 consisting of a first tubular shaft 45, driven by relative means 46 consisting of a mechanism which envisages a pair of toothed wheels 84 and 85 that engage with one another, one being keyed to the first tubular shaft 45 and the other to a powered shaft 86.

The first shaft 45 rotates about its vertical axis Z1 and the top of the shaft is fitted with a vertical pin 47, parallel with the said vertical axis Z1. The above-mentioned continuous thread 5 is attached to this pin 47 in such a way that it slides freely, the thread extending from a thread feed unit 48.

Figure 2:
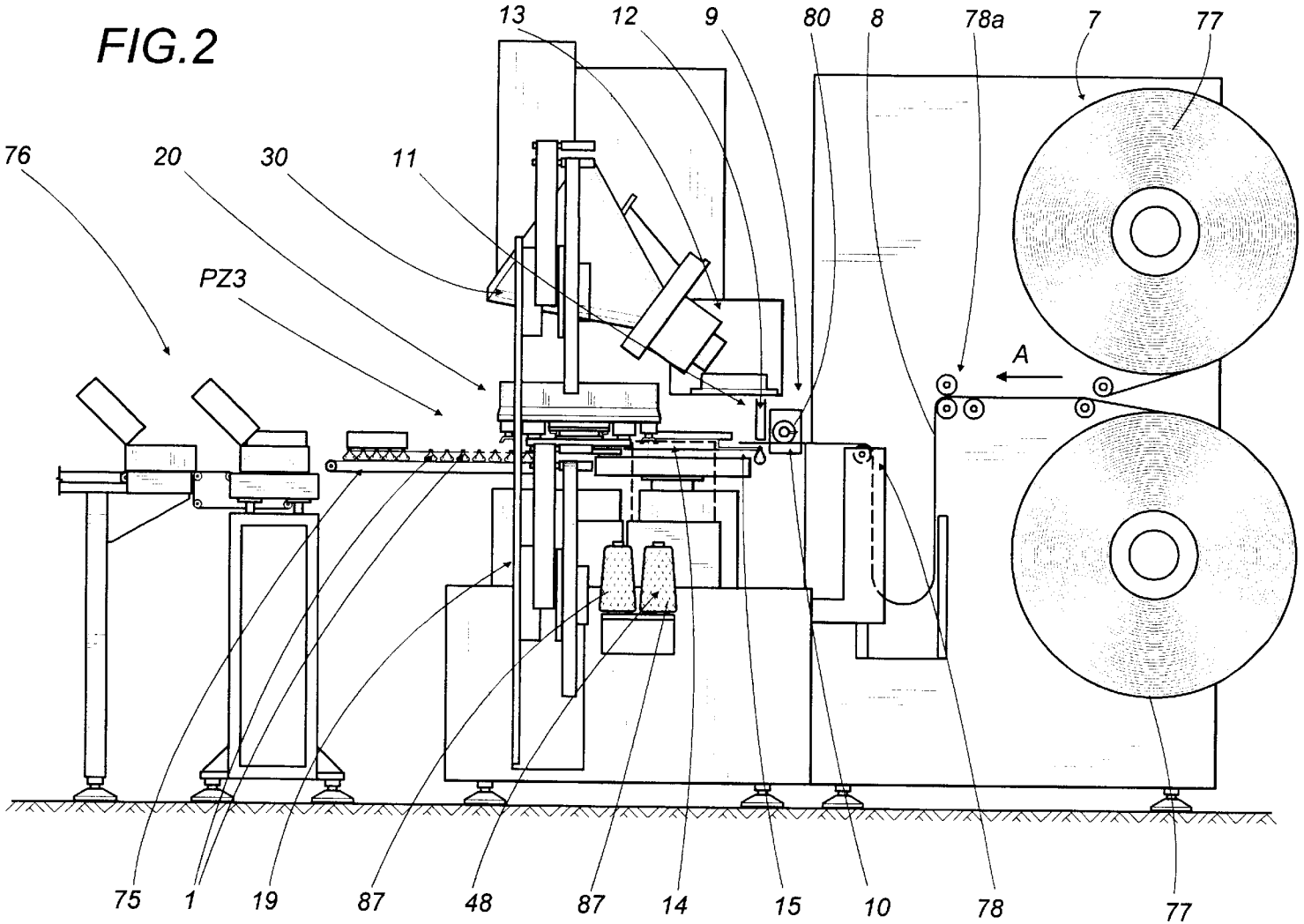
FIGS. 2, 3 and 4 are respectively front, top plan and side views of the bag packaging apparatus shown in FIG. 1.
Figure 4:
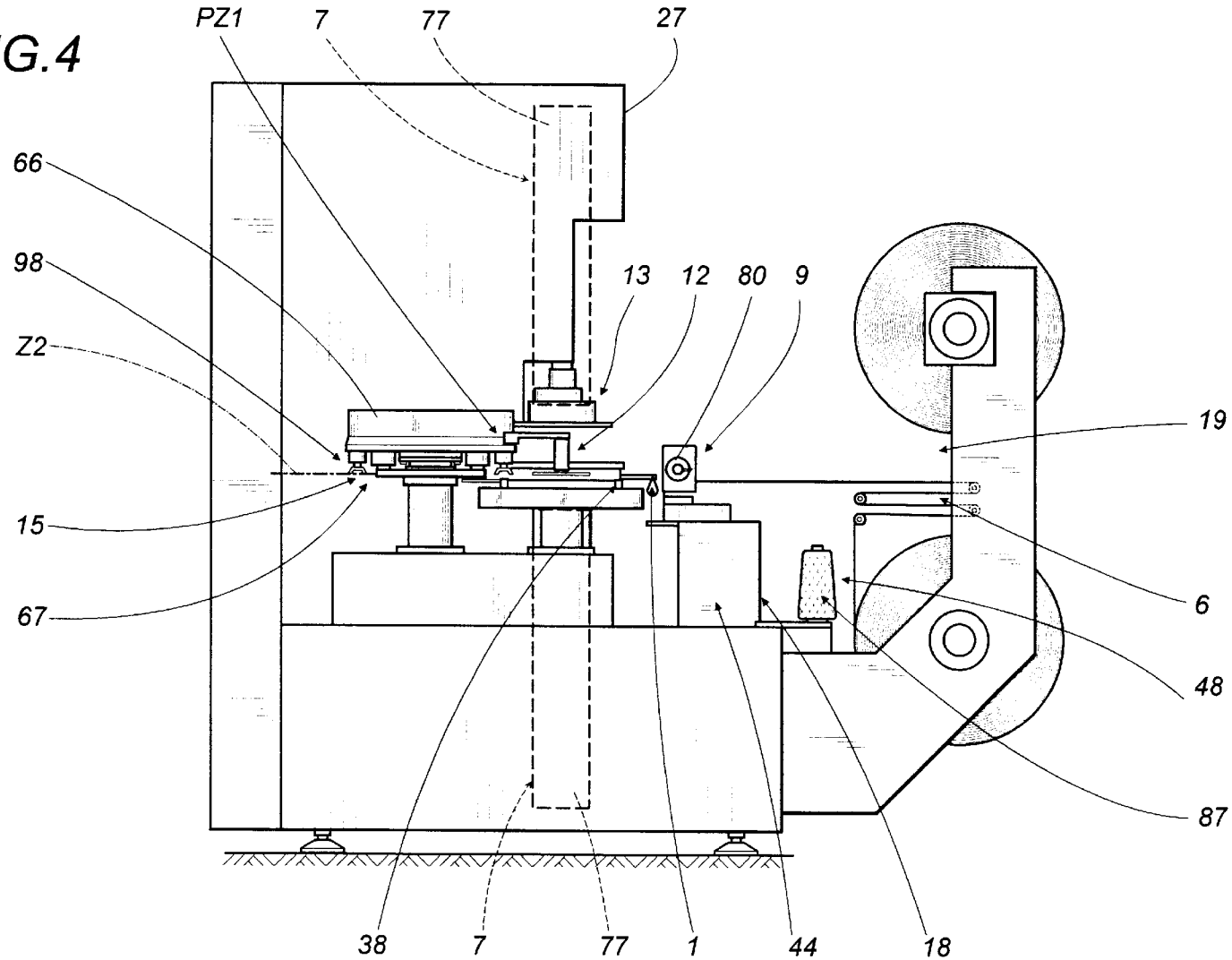

The feed unit 48 is located outside the sixth station 18 (as shown in FIGS. 2 and 4) and consists of one or more reels 87 of thread 5, which is picked up and guided, inside the first tubular shaft 45, by tensioning means 57 (see FIG. 9), located near the first tubular shaft; the thread 5 is unwound mainly by the action of the first carousel 38 as it rotates (described below), combined with the movement of the pin 47. The unwinding means 57 may consist of a plurality of idling rollers 88, keyed near an oscillating shaft 89, with which the thread 5 is held taut during the stages in which it is tied on the bag 1 (described in more detail below).

Opposite and above the said first shaft 45, is a second shaft 49, with a vertical axis, supported by a first horizontal arm 50 (see angle β in FIGS. 7, 10, 18) which can be oriented on a horizontal plane between a position for ring 51 formation (shown in FIG. 9, as a dashed line in FIG. 7 and in FIG. 18), in which the second shaft 49 is coaxial with the first shaft 45, allowing the pin 47 to rotate about the second shaft in such a way that it preforms a portion of thread 5 into a ring 51, and a position for the set-down of the ring 51 thus formed, in which the second shaft 49 is opposite the bag 1 (see FIG. 7, continuous line), still supported by the grippers 40 of the first carousel 38, stationary at that moment, and vertically aligned with its mouth 4, so that the ring 51 is set down on the zone around the mouth 4. These end positions are defined by relative drive means 55, described below.

In FIGS. 18, 19, 20 and 21, the numeral 59 labels contrast means which operate upon the second shaft 49 and are located along the vertical axis of the bag 1. The said means consist of another horizontal shaft 60, supported by a small vertical shaft 61 attached to the unit 44 and which can rotate about its axis so as to stably orient and angle the arm 60 at the gripper 40 transit zone.

The arm 60 also has a slot 62 at its free end 60*a* which can be oriented, designed to partially house the second shaft 49, when the latter is in the ring 51 set-down position.

Again observing the sixth station 18 in FIGS. 8, 9, 18, 19 20 and 21, the second shaft 49 is divided into an external bell 52 which is hollow and houses a ring 51 pick-up and release cylinder 53 in such a way that the latter slides axially (see arrow F5 in FIGS. 8, 9, 20 and 21).

The lower end of this cylinder 53 has an operating head 54, protruding from the bell 52, designed to allow the thread 5 to be wound around it and having a cavity 54*c*, which opens to the outside, surrounding the zone above the mouth 4, when the second shaft 49 is in the ring 51 set-down position: the head 54 acts as a "finger" for thread 5 winding.

Figure 9:
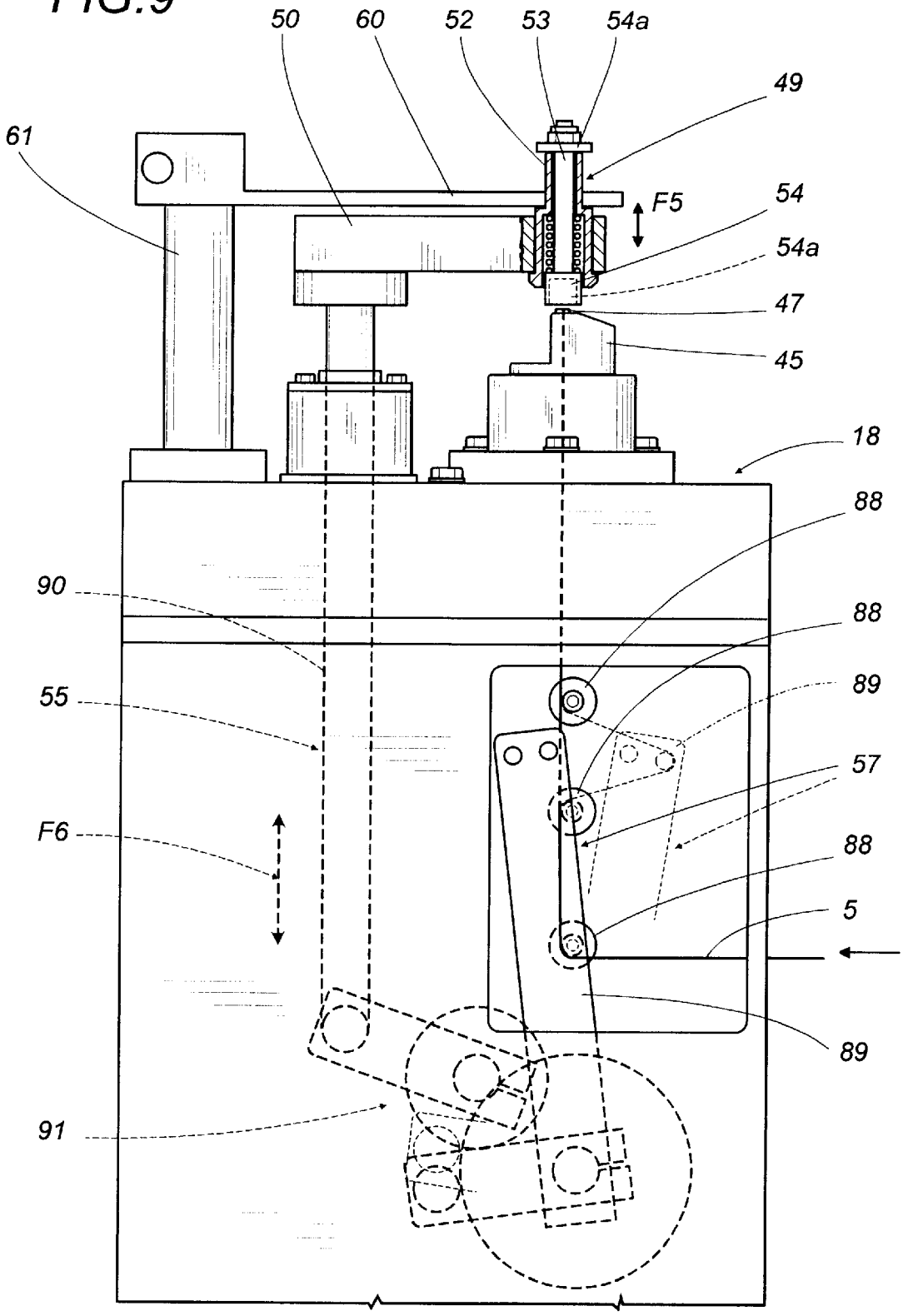

In order to wind the operating head 54 in this way, the bell 52 is integral with the first arm 50, which moves vertically (see arrow F6 in FIG. 9), as well as rotating as indicated above, driven by the means 55, which consist of a vertical rod 90 connected to a cam mechanism 91 (means shown by a dashed line in FIG. 9).

Figure 8:
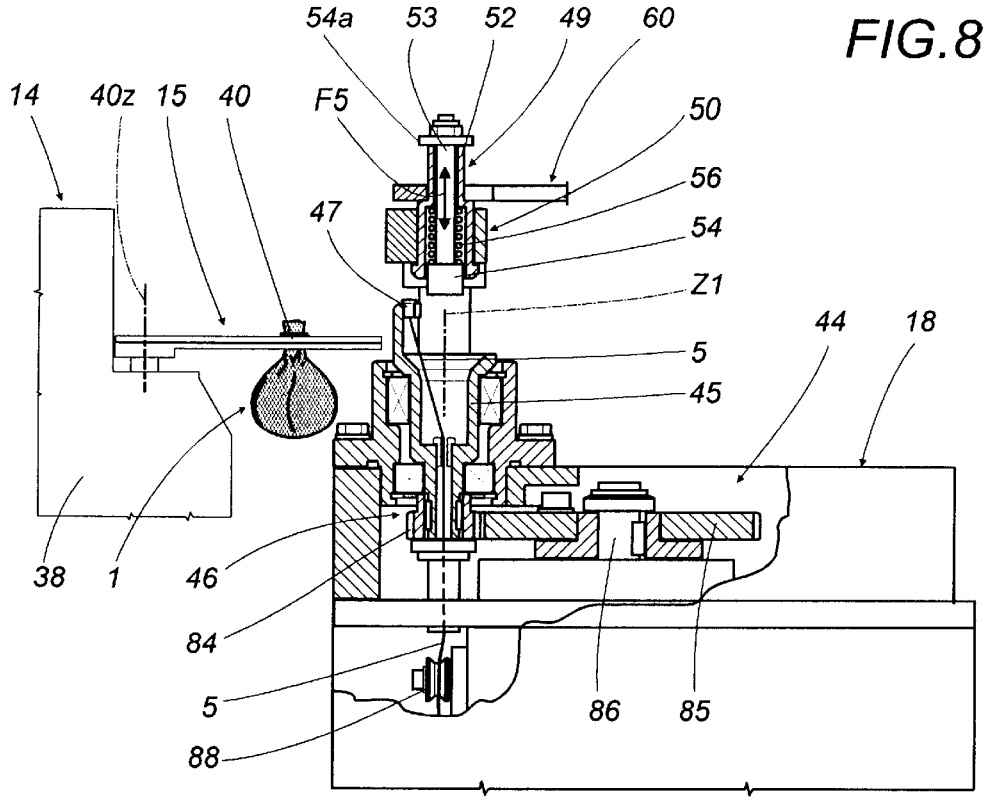
FIGS. 8 and 9 illustrate the tying station shown in FIG. 7, respectively from points C and D in FIG. 7.

Therefore, the first arm 50 can assume the following positions:

a first, raised, idle end position, in which the operating head 54 has been moved away from the first shaft 45, though it may be vertically aligned with it, and does not interfere with the pin 47 (see dashed line in FIG. 7 and FIG. 8);

a second, intermediate, operating position, in which the operating head 54 is on the horizontal plane slightly lower than the free end of the above-mentioned pin 47, thanks to lowering of the first arm 50, allowing the formation, on the cylindrical surface of the head 54, of a ring 51 by the rotation of the pin 47; in this position the first arm 50 is in the said ring 51 formation position (see FIG. 7);

finally, a third, lowered, operating position, in which the cavity 54*c* of the operating head 54 surrounds the part above the mouth 4 of the bag 1, when the first arm 50 is in the above-mentioned ring 51 set-down position.

Figure 19:
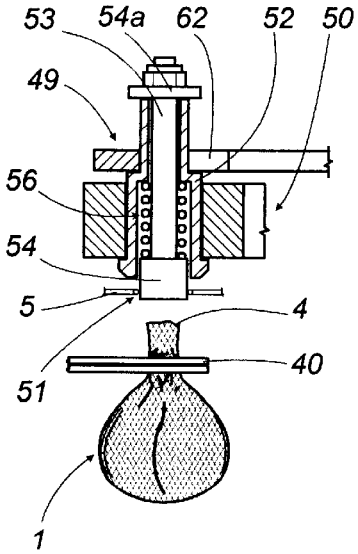
FIGS. 19, 20 and 21 are front views of the respective stages involved in depositing a ring on the bag by the station shown in FIGS. 7, 8, 9 and 18, with some parts shown in cross section.
Figure 20:
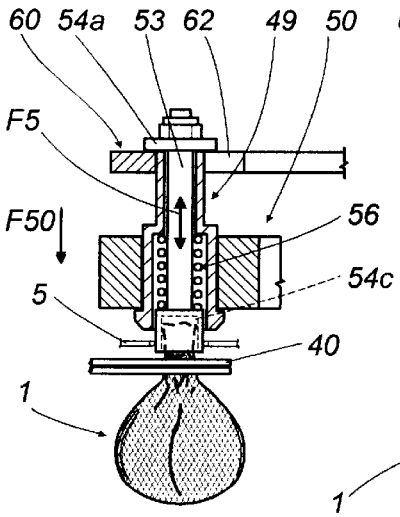
Figure 21:
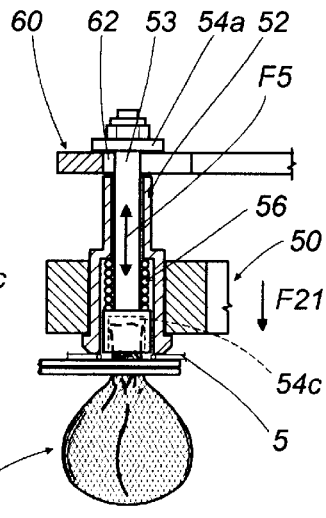

More specifically, the ring 51 set-down stages are further illustrated in schematic FIGS. 19, 20 and 21: FIG. 19 shows the arrival position of the first arm 50 on the vertical axis of the bag 1; in FIG. 20, the arm 50 completes a first stroke towards the bag 1 (arrow F50) to the point at which the cavity 54*c* surrounds most of the mouth 4 inside it, the stroke being vertically delimited by a ring 54*a,* integral with the free end of the cylinder 53, which makes contact with the arm 60. At this point, the further downstroke of the arm 50 (see FIG. 21 and arrow F21) is effected only by the bell 52 which, in this way, slides the ring 51 of thread 5 downwards, releasing it from the operating head 54 and setting it down on the part around the mouth 4.

Obviously, the return of the first arm 50 at the first shaft 47 envisages firstly raising of the first arm until it returns to the configuration in FIG. 19, then its rotation in the opposite direction to that previously employed.

Spring means 56 (a helical spring) are envisaged between the bell 52 and cylinder 53, being designed to allow the relative return stroke between the bell 52 and cylinder 53.

Figure 22:
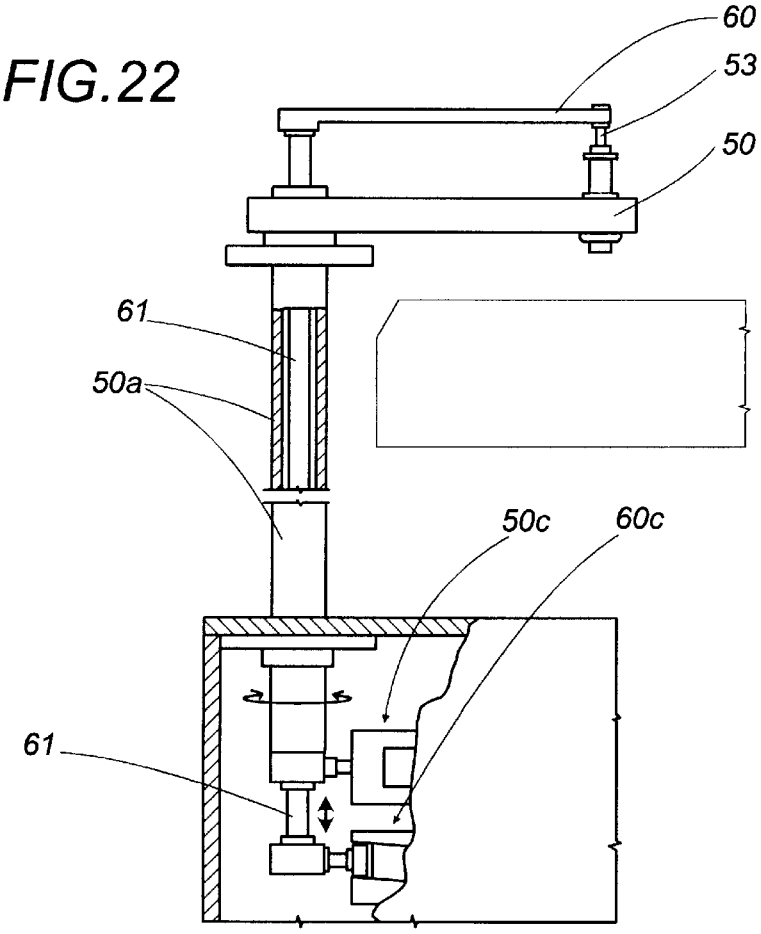
FIG. 22 is a schematic side view of another embodiment of several technical details of the tying station shown in FIG. 18, with some parts cut away to better illustrate others.

If a greater operating speed were required of the knot set-down unit, the solution illustrated using the spring 56 could be substituted with the direct control solution schematically illustrated in FIG. 22. Here, the two elements, the bell 52 and cylinder 53, are controlled by independent control elements 50, 50*a* and 60, 61 which, in turn, are controlled by independent drive means consisting of separate cams 50*c* and 60*c*.

Figure 11:
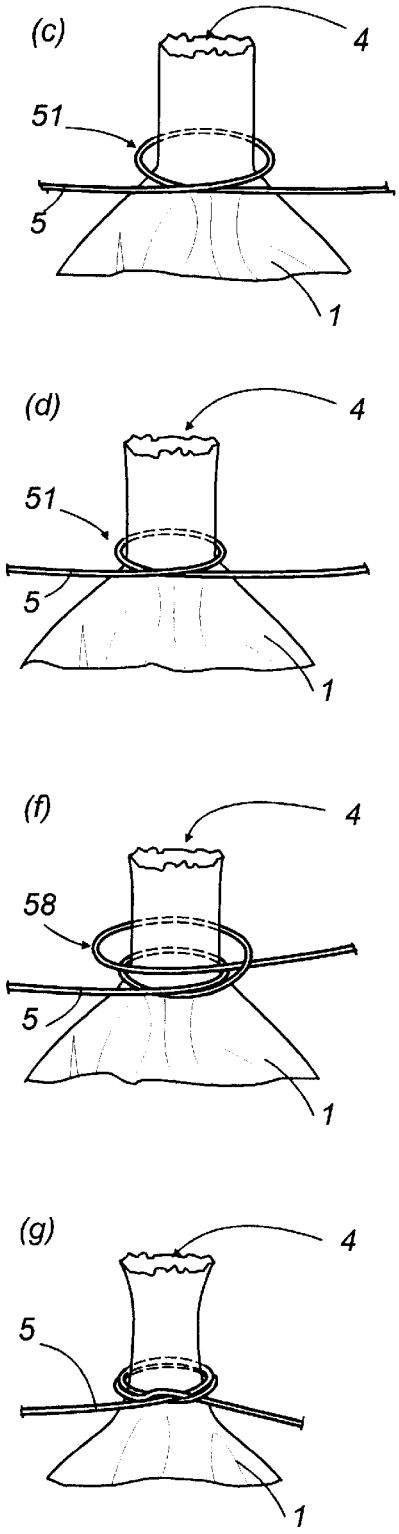
FIG. 11 shows part of the stages shown in FIG. 10, labeled below with the corresponding letters in FIG. 10, that is to say "c", "d", "f" and "g", in which part of the bag and the relative tying rings made on it are visible; all stages being shown in a partial perspective view of the bag.
Figure 10:
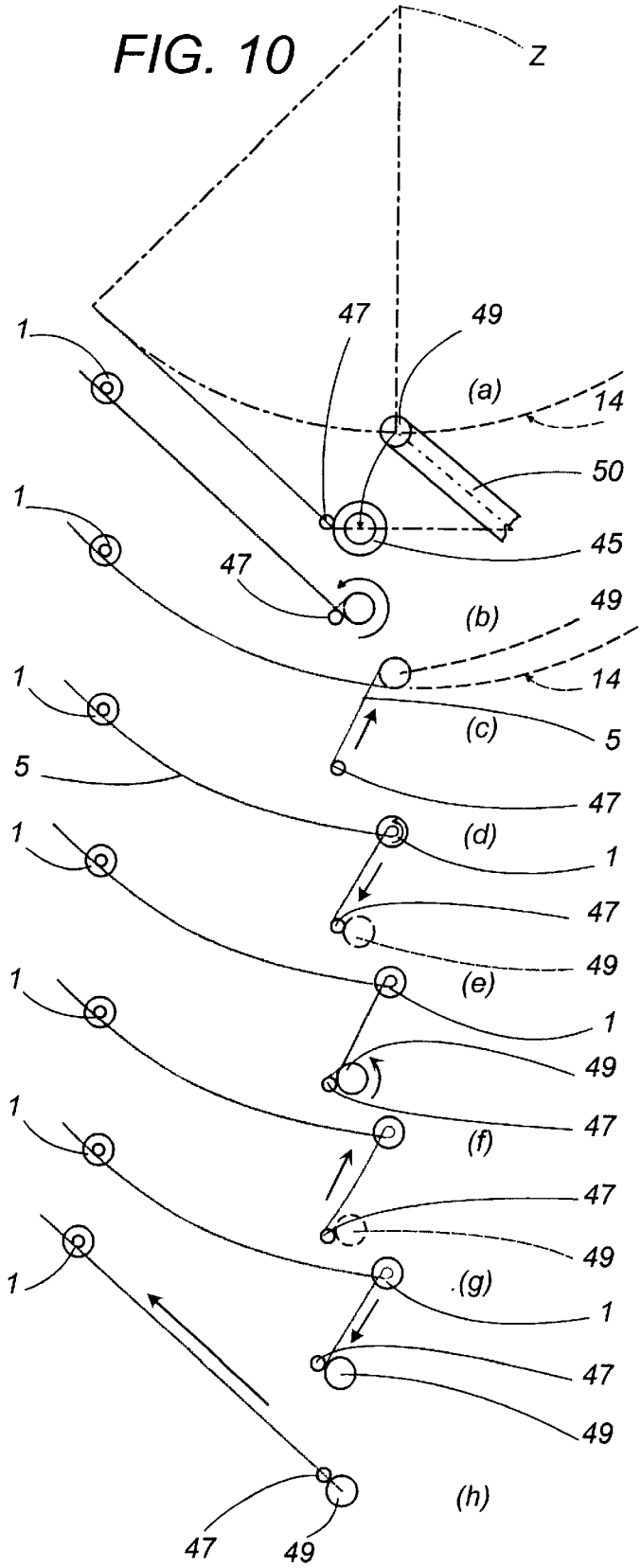
FIG. 10 shows a series of stages, labeled below with letters "a" to "h", envisaged for tying the bag as it transits through the station shown in FIGS. 7, 8 and 9, all of the sub-stages being shown in schematic top plan views.

To correctly tie off the zone around each mouth 4 on the bags 1, in this case and preferably, two of the above-mentioned tying rings are created, labeled 51 and 58, in two subsequent and substantially identical stages, as illustrated in FIGS. 1, 10 and 11 and the relative letters. The first ring 51 is wound around the bag 1 and tightened around the zone around the mouth 4 thanks to the tensioning action of the above-mentioned means 57, that is to say, oscillation of the rod 89.

Similarly, the second ring 58 is positioned over the first 51 and tightened around the zone around the mouth 4, again thanks to the oscillation of the rod 89 and due to the subsequent movement in direction of rotation F of the first carousel 38: in this way, the bag is tied off with a knot commonly known as a "clove-hitch" knot.

It has been indicated that two tying rings are preferably created: this is important since the presence of a single ring cannot create a stable closure, whilst a pair of overlapping rings form the above-mentioned clove-hitch knot which, once tightened around the mouth 4, creates a stable, irreversible closure.

More precisely, it should be noticed how the two rings are overlapped in the opposite direction to the direction of generation of the spiral by the thread 5 transit pin 47. That is to say, supposing that the spiral extends downwards, the second ring is placed over the first: stable closing of the knot can only be obtained in this way.

As clearly shown in FIGS. 7 and 10, the bag 1 thus formed has opposite portions of continuous thread 5 projecting from the bag tying zone, these portions connecting the bags 1 previously and subsequently formed to the bag just formed: in this way a continuous connection is created between the bags until the definitive formation of the individual bags (described in more detail below), thread 5 continuity also being maintained by the pins 42*p,* envisaged near each surface 41, which also tension the thread 5 as the first carousel 38 rotates.

In FIGS. 2, 3 and 12, the numeral 19 is used to label a seventh station, which feeds the labels 6 to the stationary first carousel 38 with a surface 41 at the seventh station 19.

It should be noticed that the label in question, for reasons explained below, has a slot 22 on one side which, at its inner edge, forms a seat 23 which in the embodiment illustrated by way of example only is semi-circular.

This seventh, feed station 19 for the individual labels 6 consists of a second horizontal arm 63, one end of which is equipped with grippers 64 designed to pick up an individual label 6 from a continuous strip of labels.

The other end of this second arm 63 is attached to a third vertical shaft 65, which can be angled between a pick-up position, in which the gripper end 64 is located at the continuous strip of labels 6, enabling it to pick up and clamp the label 6 (shown with a continuous line in FIG. 12), and a release position, in which the gripper end 64 is rotated through an angle $\alpha$, moved towards the fourth station 14, allowing the label 6 to be housed in the seat 42 on each surface 41. It should be noticed that each surface 41 is equipped with grippers (described below), which momentarily clamp the label 6 to the surface, until the label is subsequently released, as described below.

The second arm 63 is driven by a horizontal rod 91 connected to a mechanism 92 consisting of another arm 93 controlled by a cam 94.

The seventh station 19 is inserted inside an eighth station 20, designed to allow the label 6 to be attached to the continuous thread 5 at a predetermined point 6*a*.

In addition, the eighth station 20 has second means 21 for cutting the remaining portion of thread 5 envisaged beyond the point at which the thread was attached to the label 6.

The eighth station also contains means 24 for insertion of the label 6 at the above-mentioned tying zone, in such a way that the latter is housed in the semi-circular seat 23.

Figure 13:
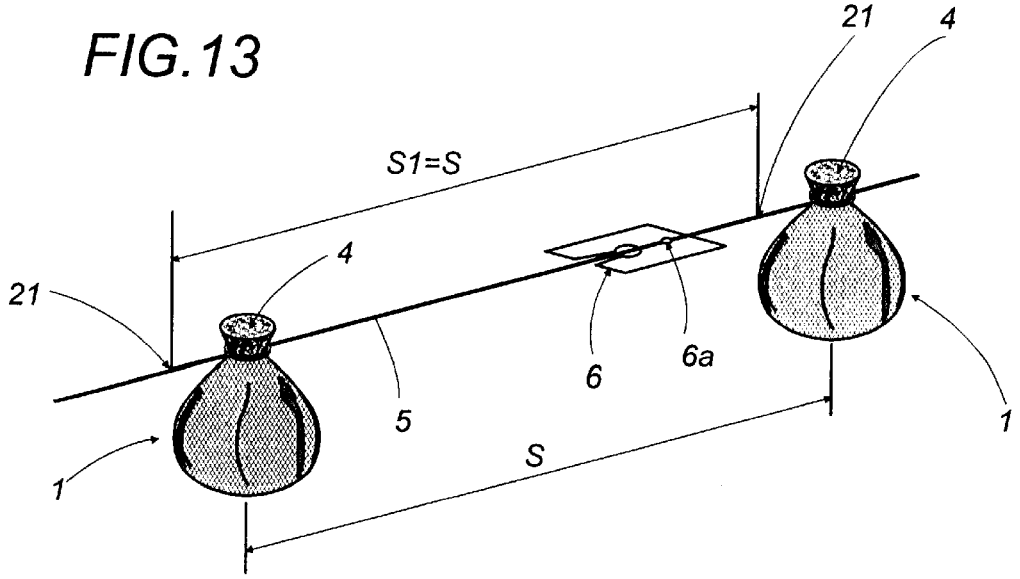
FIG. 13 is a formation diagram of a bag made using the apparatus disclosed, in particular the theoretical production of the same bag as shown at the station in FIGS. 7, 8 and 9.

As shown in schematic FIG. 13, to better create the joins between the thread 5, label 6 and bag 1 and the relative thread cutting, the above-mentioned working zones 39 are positioned one after another in a straight line, each separated by a space S1 substantially equal to the working length of the thread 5 required to produce the bag 1, the end of which may be attached to the label 6: in other words, two successive bags 1 linked to a gripper 40 are separated by a distance S equal to the working length Si of the thread 5 envisaged between a label 6 and the relative bag 1, i.e.: equal to the distance between two successive cuts.

In the order derived from the feed line A, the numeral 68 is used to label means for gluing the label 6 to the thread 5 at the above-mentioned predetermined point on the thread 5.

These gluing means 68 (see FIG. 1*h*) may consist of a cold or hot-melt liquid adhesive sprayer 95, located near the zone at which the label 6 is housed on the surface 41. The sprayer 95 may move along its longitudinal axis, starting from above the label 6, and approaching the label only when the latter is housed in the seat 42 on the surface 41.

Again close to the gluing means 68, the above-mentioned thread 5 cutting means 21 are envisaged, immediately upstream of the gluing sprayer 95 (relative to the feed line A), allowing it to be detached almost simultaneous to the depositing of the drop of glue between the label 6 and thread 5.

Figure 23:
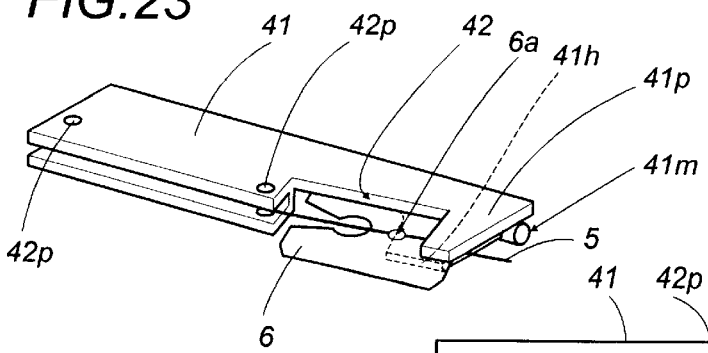
FIG. 23 is a scaled-up schematic perspective view of a support surface which is part of the first carousel shown in FIG. 7.
Figure 24:
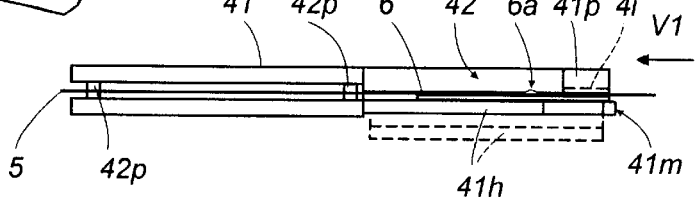
FIG. 24 is a schematic front view from point V1 relative to FIG. 23, with some parts cut away to better illustrate others.

With reference to FIGS. 23 and 24, it can be seen that the surface 41 has a tab 41*p* which forms the seat 42; beneath this tab is one end of a gripper element 41*h* (already referred to) which moves downwards, away from the tab 41*p,* driven by means generically labeled 41*m.*

The bottom of the tab 41*p* preferably has a groove 41*i,* in which the thread 5 may be housed; the gripper element 41*h,* in its closed position, clamps together the label 6—thread 5 assembly beneath the tab 41*p:* the duration of this clamping stage is sufficient to allow the glue to bind the thread 5 and label 6 during the cutting stage, without the risk of them being separated.

The second cutting means 21 (again see FIG. 1*h*) may consist of a pair of blades 96, angled and moved vertically towards and away from the thread 5; these blades 96 may be shears. Therefore, the thread 5 is cut at a zone outside the surface 41 which houses the label 6.

Proceeding along the feed line A, the eighth station 20 also comprises a second carousel 66, which rotates about its vertical axis Z2 and in a direction F1 concordant with the first carousel 38 at the fourth station 14.

The second carousel 66 is equipped with second pick-up means 67 for the bag 1 only, which intersect at a first zone PZ1 with the first pick-up means 15, that is to say, the grippers 40.

The second pick-up means 67 consist of second grippers 98, which pick up a single bag 1 at a point above the tying zone and different to that of the gripper 40 pick-up zone; the bag 1 is pick ed up by the second grippers 98 when the first carousel 38 pauses between the tying, gluing and cutting operations on successive bags 1.

Figures 15, 16:
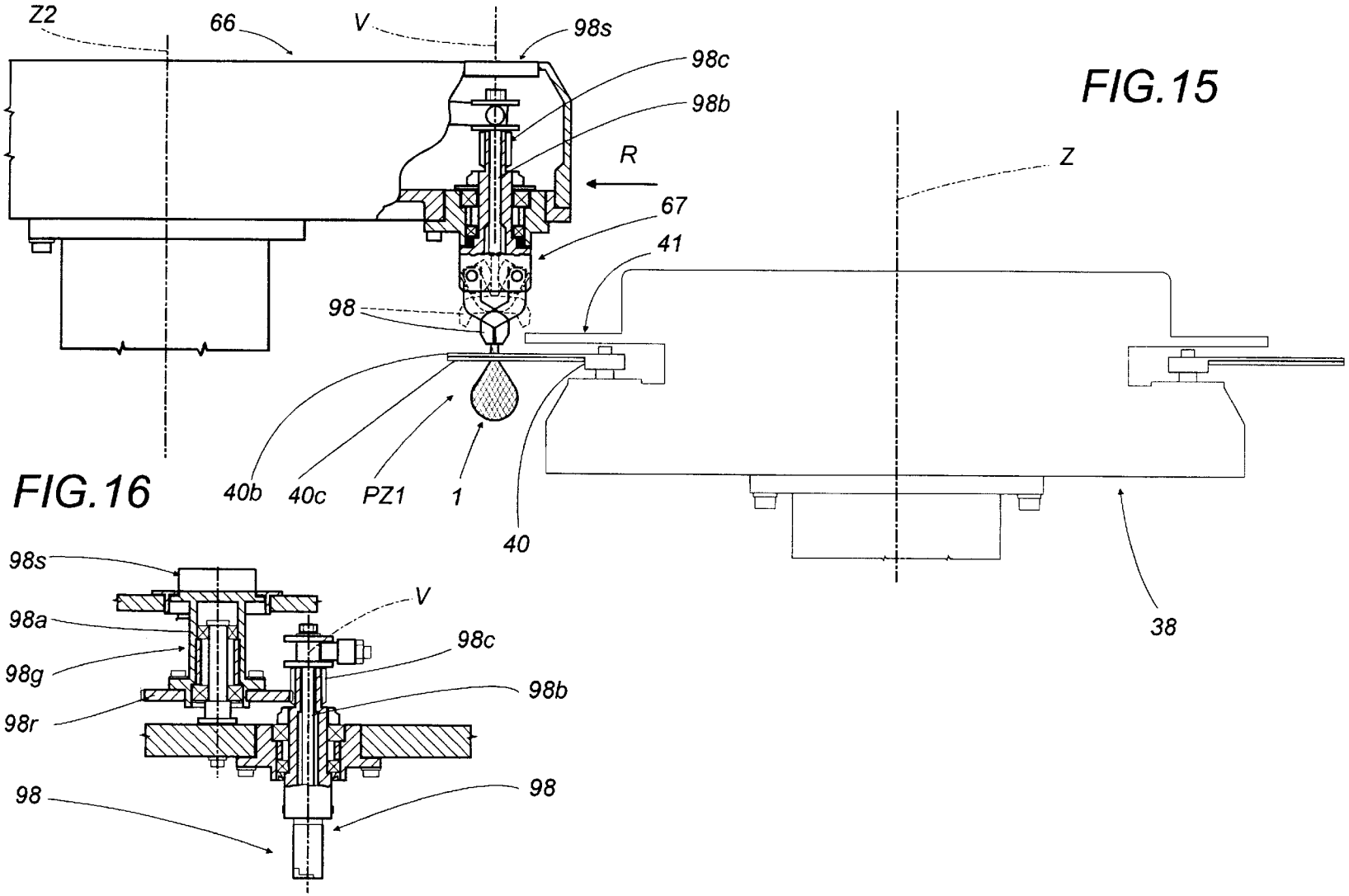
FIG. 15 is a schematic front view of part of the apparatus disclosed, inherent to a zone of intersection of two carousels which transfer the bag between the various operating stations, with some parts cut away to better illustrate others.
FIG. 16 shows a detail illustrated in FIG. 15, more precisely second grippers, as seen from point R in FIG. 15.
Figure 18:
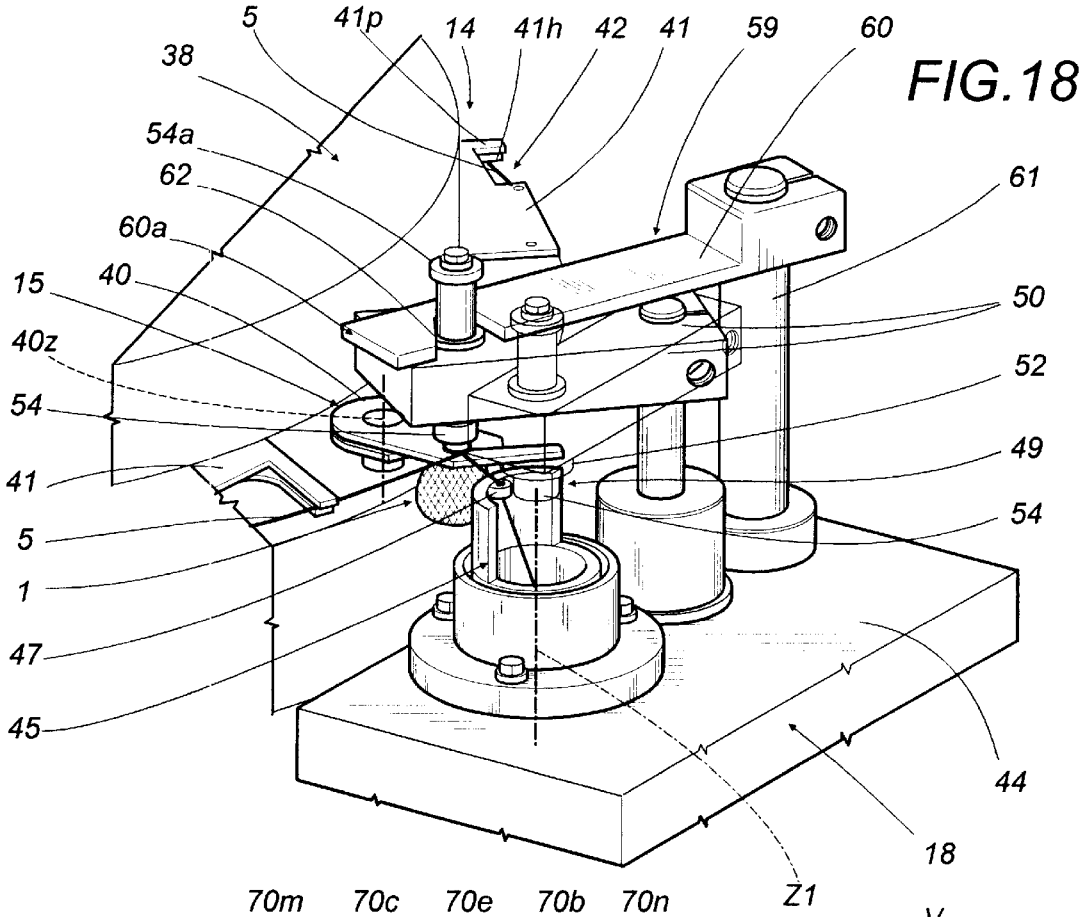
FIG. 18 is a perspective view of the tying station illustrated in FIGS. 7, 8 and 9, with some parts cut away.

As is more clearly shown in FIG. 15, the second grippers 98 pick up the bag 1 from above and along an axis vertical to the bag, to avoid intercepting the first grippers 40, which hold the bag 1 according to a horizontal plane, as already seen.

Moreover, every second gripper 98 comprises a gear ratio unit 98*g* (visible in the detail in FIG. 16) which, as indicated more clearly below, allows the corresponding second gripper 98 to rotate about its vertical axis V, winding the thread 5 around the mouth 4 of the bag 1. Each gear ratio unit 98*g* comprises a first toothed wheel 98*r*, keyed to a small vertical shaft 98*a* parallel with the corresponding gripper 98 support shaft 98*b,* a second toothed wheel 98*c,* engaged with the first 98*r,* being keyed to the shaft 98*b.* In addition, the gear ratio unit 98*g* has a seat 98*s* for the insertion of a clutch unit 69, described in more detail below.

Returning to the second carousel 66 and second grippers 98, as the second carousel rotates, it brings the bag 1 near to the above-mentioned means 24 for insertion of the label 6 at the thread 5 tying zone.

The label insertion means 24 are substantially located between the zone in which the second cutting means 21 and gluing means 68 operate and the second carousel 66.

As it rotates, the second carousel 66 brings the bag 1 just picked up to a zone, labeled PZ2 in FIG. 12, subsequent to the first zone of intersection PZ1 relative to the direction of rotation F1 of the second carousel 66, and where it can be reached by the insertion means 24.

Figure 17:
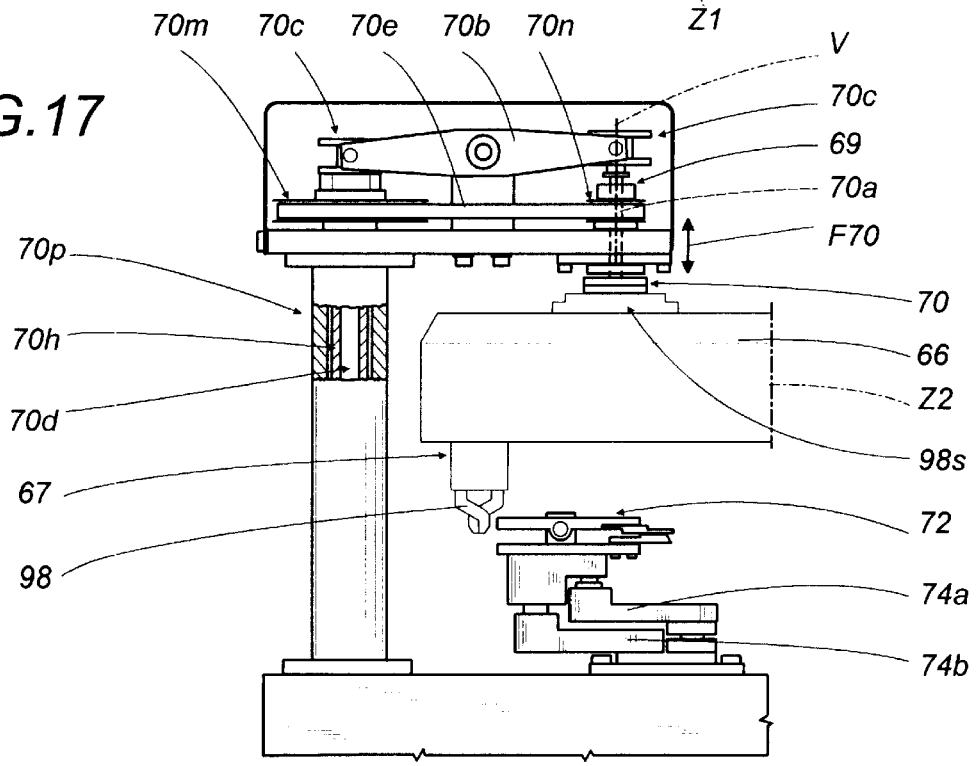
FIG. 17 is a front view of part of a station on the apparatus in which the final configuration of the bag is defined, with some parts cut away to better illustrate others.

Above the second carousel 66 and on the vertical axis of the second zone PZ2, is the above-mentioned clutch unit 69 (see FIG. 17). This clutch unit 69 consists of a circular clutch 70 attached to a shaft 70*a* supported by a bridge structure 70*p* housing the elements which move the clutch 70 vertically and allow it to rotate.

These elements, by way of example only, may consist of a rocker arm 70*b* and relative control tappets 70*c* and a pair of pulleys 70*m,* 70*n* keyed to a rotating tube 70*h* and to the shaft 70*a,* and connected to one another by a toothed belt 70*e.*

The clutch 70 must engage inside the corresponding seat 98*s* of the second grippers 98 when the latter arrives at zone PZ2 (see arrow F70 in FIG. 17) and begin rotating there.

The drive created by the clutch 70 allows the grippers 98 to rotate, thanks to the latter's connection to the gear ratio unit 98*g,* thus winding the thread 5 around the tying zone on the mouth 4 of the bag 1, whilst at the same time the label 6 is moved towards and inserted in the said zone by the insertion means 24.

The gear ratio unit allows the second grippers 98 to effect a limited number of turns to wind the thread around the mouth 4; the number of turns performed by the second grippers 98 preferably being between 2 and 4.

The label 6 pick-up stage occurs as the bag 1 is transferred from the first carousel 38 to the second carousel 66, whilst the label is attached to the bag 1 as the thread 5 is wound by the grippers 98; this prevents excessive tensioning of the thread 5 during the transfer and winding movements.

The label 6 insertion means 24 consist of a horizontal arm 72, one free end of which is equipped with grippers 73 for label 6 pick-up and release.

The third arm 72 is controlled by cam means 74, designed to allow an articulated parallelogram rototranslation on a horizontal plane of the arm, from a position in which it picks up the label 6 located on the surface 41 of the first carousel 38, to a label 6 attachment position, in which the third arm 72 moves backwards, away from the first carousel 38, then diverts towards the grippers 98 (see arrow F7 in FIG. 12) and attaches the label 6 to the bag 1.

In order to allow this movement by the third arm 72, the cam means 74 consist of a pair of horizontal rods 74*a* and 74*b,* connected in the shape of an articulated parallelogram and in turn controlled by a toggle 99 controlled by a cam profile 100 which cyclically controls the above-mentioned movement of the third arm 72 in both directions.

Once the label 6 has been attached to the bag 1, the clutch 70 in the clutch unit 98*g* is raised and allows the second carousel 66 to continue its rotation F1.

As it turns, the second carousel 66 arrives at an unloading zone PZ3, obviously after the second zone of intersection PZ2 relative to the direction of rotation F1 of the same carousel.

A conveyor belt 75 is located at this unloading zone PZ3, below the second carousel 66, and it is here that the grippers 98 release the bags 1 just produced. The conveyor belt 75 transfers the bags 1 to a subsequent packaging station 76, of the known type and, therefore, not fully illustrated and described.

The present invention, for the objects indicated, may be subject to numerous modifications and variations, all encompassed by the design concept. Moreover, all components may be substituted with technically equivalent parts.

What is claimed:

1. A packaging apparatus for the production of bags for products for infusion, each of the bags including a mouth and being formed from a piece of woven fabric, in which a dose of said product is deposited; a tying thread being wound around the mouth of the bag; a label being attached to the thread, the label adapted for supporting and handling the bag while making an infusion, the apparatus comprising sequentially along a feed line:

a first station which feeds a continuous strip of said fabric in a flat configuration towards a second station equipped with a transverse cutting unit adapted for cutting the strip into a series of flat pieces of fabric;

a third station, having means for transforming the pieces of fabric from the flat configuration to a bag configuration, the bag being generally tubular in shape and having an open top which forms the mouth; the third station also comprising means for feeding a dose of the product into the bag;

a fourth station, having first means for picking up the tubular bag by a portion of the bag below the mouth, this fourth station also adapted for transferring the tubular bag to a fifth station, having first means for cutting a predetermined portion of the open top of the tubular bag which is not held by the means for picking up the bag;

a sixth station adapted to wind and tie off the tying thread around the bag mouth forming a closed bag containing a single dose of the product, the tying thread having first and second projecting portions continuously connecting a previous and a subsequent bag;

a seventh station for feeding a label to the first projecting portion of the tying thread;

an eighth station adapted for attachment of the label at a predetermined point on the continuous thread; the eighth station having second means for cutting the second portion of thread which extends beyond the predetermined point at which the label is attached;

wherein, the sixth station comprises a first driven tubular shaft rotatable about a vertical axis, an upper end of the shaft including a thread locating boss being vertical and parallel with said vertical axis; the continuous thread extending from a thread feed unit and through the boss; a second shaft opposite the first shaft having a vertical axis and supported by a first horizontal arm, movable between a thread ring formation position, in which the second shaft is coaxial with the first shaft and the boss is positioned to rotate about the second shaft to preform a portion of the thread into a ring shape, and a ring set-down position, in which the second shaft is positioned over the mouth of a bag positioned in the fourth station, so as to downwardly position and deposit the ring around the mouth of the bag.

2. The apparatus according to claim 1, wherein the eighth station includes means for attaching a seat of the label to the mouth of the bag.

3. The apparatus according to claim 2, wherein the means for attaching the label includes a fourth horizontal arm, having a free end equipped with grippers adapted for pick-up and release of the label; said fourth arm being driven by cam means adapted to cause rototranslation of the fourth arm on a horizontal plane from a position in which the label is picked up close to the fourth station, to a label attachment position, in which the fourth arm is moved away from the fourth station to attach the label to the mouth of the bag.

4. The apparatus according to claim 1, wherein the means for transforming the piece of fabric include an open tubular element, being positioned vertically relative to the feed line; the tubular element being supported and moved by an end of a horizontal arm attached to a support structure on the apparatus; the tubular element being vertically and axially movable relative to a fixed, tubular internal guide and support element between a raised configuration, in which the tubular element completely surrounds the guide element, and a lowered operating configuration, in which the tubular element forms a lower extension of the guide element, the tubular element adapted for intercepting the flat piece of fabric and deforming it into a bag shape.

5. The apparatus according to claim 4, and including a vertical ejector, positioned opposite the tubular element and movable towards and away from the bag, adapted for inserting a dose of product into the bag when the tubular element is in the lowered position.

6. The apparatus according to claim 4, and including a sliding surface for supporting the piece of fabric, said surface having a hole for drawing the piece of fabric, the hole being coaxial to the tubular element; holding means adjacent the hole adapted to clamp a portion of the bag adjacent a lower portion of the sliding surface when the tubular element is in the lowered position.

7. The apparatus according to claim 4, wherein the means for feeding a dose includes: a product holder and dosing drum rotatable about a vertical axis; said drum having a plurality of through-holes forming compartments which hold portions of the product evenly distributed around a circumference of the drum, a lower section of the drum being closed by a base having a single hole for the passage and discharge of the dose and being vertically positioned relative to the ejector; and a feed hopper for said product being positioned above the drum and adapted for supplying product to the drum.

8. The apparatus according to claim 7, and further including means for evenly distributing the product inside the compartments.

9. The apparatus according to claim 7, wherein the means for evenly distributing the product includes a plurality of mixing blades, rotating about the vertical axis at a center of the drum.

10. The apparatus according to claim 4, wherein the support arm for the tubular element is movable between two end positions, towards the support structure and then away from the structure, in the end position away from the support structure the tubular element is positioned to allow the bag to be picked up by first pick-up means.

11. The apparatus according to claim 1, wherein the fourth station includes a first carousel having a vertical axis of rotation and a plurality of working zones evenly distributed around a circumference of the first carousel; the first means for picking up including a gripper positioned in each of the working zones for clamping the bag at the portion below the mouth; and a plurality of label seats positioned on the carousel interspersed between the grippers, each seat adapted for holding a label.

12. The apparatus according to claim 11, wherein a space between two adjacent grippers is substantially equal to a working length of the thread.

13. The apparatus according to claim 11, wherein each of the first grippers includes a body, having a pair of jaws which rotate about a vertical axis of the body; said jaws being shaped so that when closed, they form a complementary seat which supports and houses the portion of the bag below the mouth.

14. The apparatus according to claim 11, wherein each label seat has at least one pair of vertical pins adapted to hold a continuous thread joining the bags to the labels in succession, defining a portion of an arc which copies an external circumference of the first carousel when the first carousel completes a rotation along the feed line.

15. The apparatus according to claim 11, wherein each label seat has a tab; beneath the tab there being one end of a gripper element movable towards and away from the tab; the base of the tab also having a groove adapted to house the continuous thread.

16. The apparatus according to claim 1, wherein the fifth station includes at least one blade supported by a structure positioned near the fourth station; said blade being movable between a forward operating position, in which the blade intercepts the portion of the bag which forms the mouth at a predetermined height relative to the first pick-up means, and an idle position, in which the blade has moved away from the bag.

17. The apparatus according to claim 1, wherein the fifth station includes at least one pair of jaws for clamping a free end of the mouth to form a cylindrical portion of the free end positioned above the first pick-up means and movable between an idle position, in which the jaws are moved away from one another and from the mouth, and an operating position, in which the jaws are brought together to clamp the bag at a position above the first means for picking up and adapted for vertically tensioning a portion of the bag for cutting by a blade.

18. The apparatus according to claim 17, and further including an ejection unit located above the jaws for ejecting a cut portion of the bag, the ejection unit including a vacuum duct.

19. The apparatus according to claim 1, wherein the continuous thread is fed from the thread feed unit located outside the sixth station, the thread being guided and tensioned within the first tubular shaft by tensioning means located near the first tubular shaft.

20. The apparatus according to claim 1, wherein the first arm includes means for determining the set-down position for the ring; said means including a second horizontal arm supported in a desired position by a vertical shaft attached to the apparatus, said arm having a slot at a free end adapted to partially house the second shaft.

21. The apparatus according to claim 20, wherein the second shaft includes an axially movable bell and a pick-up and release cylinder for the ring; a lower end of the cylinder having an operating head, protruding from the bell and an opening adapted to surround the mouth, the cylinder being adapted for having the thread loop formed around an exterior thereof; said bell being integral with the first arm, and vertically movable between several different positions, including:

a first, raised, idle position, in which the operating head is moved away from the first shaft and does not interfere with the boss;

an intermediate operating position, in which the operating head is on a horizontal plane lower than a free end of the boss, allowing the thread to be wrapped around its exterior to form the ring, and a lowered operating position, corresponding with the ring set-down position of the first horizontal arm, in which the cavity of the operating head surrounds the mouth and allows the ring to be released onto the bag as the bell is moved down the cylinder, the bell being vertically and axially limited in travel by a limit ring located at the free end of the cylinder and being adapted to make contact with the second horizontal arm as the first horizontal arm moves towards the lowered operating position.

22. The apparatus according to claim 21, and including spring means disposed between the bell and the cylinder providing a return stroke between said bell and said cylinder when the bell returns to the raised end position.

23. The apparatus according to claim 21, wherein two tying rings are created using the continuous thread on each bag during two successive stages, one being placed over the other and locked around the mouth each time the first arm returns to the ring formation position.

24. The apparatus according to claim 23, wherein the two tying rings are overlapped in an opposite direction to a direction of generation of the loop formed by the boss.

25. The apparatus according to claim 1, wherein the seventh label feed station includes a third horizontal arm, having an end fitted with grippers adapted to pick up an individual label from a continuous strip of labels; an other end of the third arm being attached to a third vertical shaft and adapted for movement between a pick-up position, in which the grippers are positioned at the continuous strip of labels for the pick-up and clamping of the label, and a release position, in which the grippers are turned through a defined angle and moved towards the fourth station, allowing the label to be housed in a seat.

26. The apparatus according to claim 1, wherein the eighth station comprises a second carousel rotatable about a vertical axis and in a direction concordant with a first carousel; the second carousel being equipped with second means for picking up the bag, intersecting in a first zone of intersection with said first means for picking up and adapted to pick up the bag from the first means for picking up above the thread wound around the mouth of the bag and along a vertical axis of the bag and transfer the bag close to means for attaching the label to the mouth of the bag.

27. The apparatus according to claim 26, and including means for gluing a predetermined point of the thread to the label before the bag passes into the second carousel, the means for gluing positioned between the seventh station and the second carousel.

28. The apparatus according to claim 27, and including second means for cutting the thread after the point at which the thread is glued to the label, the second means for cutting positioned close to the gluing means and the second carousel.

29. The apparatus according to claim 27, wherein the label has a slot on one side forming, at an inner edge, a seat, the eighth station having means for attaching the label to the mouth of the bag by positioning the seat of the label over the mouth of the bag.

30. The apparatus according to claim 26, wherein the second means for picking up of the second carousel each rotate about a vertical axis and intersect a second zone of intersection with the label attaching means, when the second carousel moves after the first zone of intersection in the direction of rotation, simultaneously winding the thread around the mouth of the bag and attaching the label to the mouth of the bag.

31. The apparatus according to claim 26, and including a clutch unit adapted to activate rotation of the second pick-up means, thereby winding the thread around the bag.

32. The apparatus according to claim 31, wherein the second carousel includes an unloading zone after the second zone of intersection relative to a direction of rotation of the second carousel; there being positioned at the unloading zone, a conveyor belt below the second carousel adapted to transfer the bags to a packaging station.

33. An apparatus for tying a mouth of a bag for products for infusion, comprising:

a frame;

a first driven tubular shaft mounted to the frame and rotatable about a vertical axis, an upper end of the shaft including a thread locating boss being vertical and parallel with said vertical axis;

a continuous thread extending from a thread feed unit and through the boss;

a second shaft opposite the first shaft having a vertical axis and supported by a first horizontal arm mounted to the frame, the second shaft movable between a thread ring formation position, in which the second shaft is coaxial with the first shaft and the boss is positioned to rotate about the second shaft to preform a portion of the thread into a ring shape, and a ring set-down position, in which the second shaft is positioned over the mouth of a bag, so as to downwardly position and deposit the ring around the mouth of the bag.

34. A method for the production of a bag for products for infusion, wherein the bag is formed in a series of stages, comprising:

a first stage, in which a dose of the product is deposited on a flat piece of fabric;

a second stage for forming the flat piece of fabric into a generally tubular bag configuration having a closed bottom end and an open top forming a bag mouth with the dose closed inside the bag;

a third stage, in which a first loop of thread is formed about an axis separate from an axis of the mouth of the bag, moved to a position above the mouth of the bag, moved downwardly over the mouth of the bag and tightened around the mouth of the bag, a second loop of thread having a same configuration as a configuration of the first loop of thread is formed about an axis separate from the axis of the mouth of the bag, moved to a position above the mouth of the bag, moved downwardly over the mouth of the bag to a position adjacent the first loop and tightened around the mouth of the bag to close the bag, a fourth stage, in which a label is attached to an end of the thread protruding from the bag.

35. The method according to claim 34, wherein during the third stage the thread is wound around the mouth along a path which creates a clove-hitch knot.

36. The method according to claim 34, and including a sixth stage for attaching a slotted seat of the label adapted for grasping the mouth to the mouth of the bag.

37. The method according to claim 34, and including a fifth stage for winding the thread around the mouth by rotating the bag about its vertical axis parallel with the mouth.

38. The method according to claim 34, and including, before the third stage for closing the bag, a stage for cutting a free portion of the mouth, transforming this portion into a cylindrical configuration adapted to have the thread wound around it during a subsequent closing stage.

* * * * *